US007096936B1

(12) United States Patent
Chastine et al.

(10) Patent No.: US 7,096,936 B1
(45) Date of Patent: Aug. 29, 2006

(54) REFRIGERATOR WITH QUICK CHILL AND THAW SYSTEM

(75) Inventors: Gary Lester Chastine, Louisville, KY (US); Edgardo Torres, Louisville, KY (US); Michael Saba, Louisville, KY (US); Ronald Gary Foster, Louisville, KY (US)

(73) Assignee: General Electric Company, Schenectady, NY (US)

( * ) Notice: Subject to any disclaimer, the term of this patent is extended or adjusted under 35 U.S.C. 154(b) by 248 days.

(21) Appl. No.: 09/589,330

(22) Filed: Jun. 7, 2000

(51) Int. Cl.
*F25B 29/00* (2006.01)
*F25D 17/06* (2006.01)
*F25D 17/08* (2006.01)

(52) U.S. Cl. ..... 165/253; 165/61; 62/407; 62/417; 62/414

(58) Field of Classification Search ..... 165/253, 165/918, 919, 61; 62/187, 408, 441, 440, 62/131, 407, 417, 414
See application file for complete search history.

(56) References Cited

U.S. PATENT DOCUMENTS 3,077,749 A * 2/1963 Jung et al. ..... 62/417
3,659,429 A 5/1972 McLean
3,747,361 A 7/1973 Harbour
3,759,053 A 9/1973 Swaneck, Jr.
3,918,269 A 11/1975 Summers et al.
4,126,775 A * 11/1978 Wyatt
4,326,390 A 4/1982 Brooks
4,358,932 A 11/1982 Helfrich, Jr.
4,368,622 A 1/1983 Brooks
4,385,075 A 5/1983 Brooks
4,505,131 A * 3/1985 Boxall ..... 62/407
4,732,009 A 3/1988 Frohbieter
4,858,443 A 8/1989 Denpou
4,876,860 A 10/1989 Negishi
5,069,273 A * 12/1991 O'Hearne
5,212,962 A 5/1993 Kang et al.
5,385,032 A * 1/1995 Martin et al. ..... 62/187
5,388,418 A * 2/1995 Martin et al. ..... 62/131
5,758,512 A 6/1998 Peterson et al.
5,782,174 A * 7/1998 Cohn et al.
6,014,867 A * 1/2000 Fl.o slashed.ysvik ..... 62/414
6,463,752 B1 * 10/2002 Mandel et al. ..... 62/414
2002/0126544 A1 * 9/2002 Holmes et al.

FOREIGN PATENT DOCUMENTS

EP 0 550 984 A1 * 7/1993

* cited by examiner

*Primary Examiner*—Ljiljana Ciric
(74) *Attorney, Agent, or Firm*—Armstrong Teasdale, LLP

(57) ABSTRACT

A quick chill and thaw system includes an air handler mounted in a fresh food compartment of a refrigerator and drawing air from a freezer compartment for rapid chilling of items inside a slide-out pan. The air handler produces convective airflow at temperatures within the pan at temperatures above and below a temperature of the fresh food compartment to achieve both chilling and thawing of items in the pan.

52 Claims, 20 Drawing Sheets

REFRIGERATOR WITH QUICK CHILL AND THAW SYSTEM

BACKGROUND OF THE INVENTION

This invention relates generally to refrigeration devices, and more particularly, to refrigerator devices with quick chill and thaw systems.

A typical household refrigerator includes a freezer storage compartment and a fresh food storage compartment either arranged side-by-side and separated by a center mullion wall or over-and-under and separated by a horizontal center mullion wall. Shelves and drawers typically are provided in the fresh food compartment, and shelves and wire baskets typically are provided in the freezer compartment. In addition, an ice maker may be provided in the freezer compartment. A freezer door and a fresh food door close the access openings to the freezer and fresh food compartments, respectively.

Typical refrigerators require extended periods of time to cool food and beverages placed therein. For example, it typically takes about 4 hours to cool a six pack of soda to a refreshing temperature of about 45° F. or less. Beverages, such as soda, are often desired to be chilled in much less time than several hours. Thus, occasionally these items are placed in a freezer compartment for rapid cooling. If not closely monitored, the items will freeze and possibly break the packaging enclosing the item and creating a mess in the freezer compartment.

Numerous quick chill and super cool compartments located in refrigerator fresh food storage compartments and freezer compartments have been proposed to more rapidly chill and/or maintain food and beverage items at desired controlled temperatures for long term storage. See, for example, U.S. Pat. Nos. 3,747,361, 4,358,932, 4,368,622, and 4,732,009. These compartments, however, undesirably reduce refrigerator compartment space, are difficult to clean and service, and have not proven capable of efficiently chilling foods and beverages in a desirable time frame, such, as for example, one half hour or less to chill a six pack of soda to a refreshing temperature. Furthermore, food or beverage items placed in chill compartments located in the freezer compartment are susceptible to undesirable freezing if not promptly removed by the user.

Attempts have also been made to provide thawing compartments located in a refrigerator fresh food storage compartment to thaw frozen foods. See, for example, U.S. Pat. No. 4,385,075. However, known thawing compartments also undesirably reduce refrigerator compartment space and are vulnerable to spoilage of food due to excessive temperatures in the compartments.

Accordingly, it would be desirable to provide a quick chill and thawing system for use in a fresh food storage compartment that rapidly chills food and beverage items without freezing them, that timely thaws frozen items within the refrigeration compartment at controlled temperature levels to avoid spoilage of food, and that occupies a reduced amount of space in the refrigerator compartment.

BRIEF SUMMARY OF THE INVENTION

In an exemplary embodiment of the invention, a modular air handler for a quick chill and thaw system for a refrigerator is provided to produce convective airflow within a slide-out pan at temperatures above and below a temperature of the fresh food compartment to achieve both chilling and thawing of items in the pan.

The air handler includes a first damper element adapted for flow communication with a supply of air, such as a refrigerator freezer compartment through an opening in a center mullion wall of the refrigerator so that a supply airflow path of the air handler is in flow communication with the first damper element. A fan in the air supply path discharges air from the air supply path into the pan, and a re-circulation airflow path allows mixing of air from the pan with freezer air in the supply airflow path.

The first damper element is a dual element damper that opens and closes first and second air supply ports when the quick chill and thaw system is in a chill mode. The first airflow port is in flow communication with the supply airflow path, and the second airflow port is in flow communication with a return duct that directs air from the pan back to the freezer compartment. In one embodiment, a full-time re-circulation path is also provided in fluid communication with the supply airflow path to increase airflow and enhance performance of the air handler.

A second damper element is located in flow communication with the supply airflow path and the return airflow path. The second damper is closed in a quick chill mode. In a thaw mode the second damper is opened to allow additional air in the return path to re-circulate and mix with the supply airflow path, thereby boosting overall airflow and the resultant thawing effectiveness. A heater element is located in the return duct for warming air in said air handler in the thaw mode. A temperature sensor is located in flow communication with at least one of the re-circulation flow paths and the return flow path for temperature responsive operation of the quick chill and thaw system.

A vane is positioned in the air supply path downstream from the fan to improve airflow in the pan by dispersing air within the pan and directing air onto food or beverage items placed in the pan. The vane includes a plurality of contoured fins for dispersing air laterally as air is discharged through the vane from above and behind the pan. A tray and rack are also provided that facilitate optimal positioning of items within the pan to achieve desired airflow.

The air handler is modular in construction to facilitate service, maintenance, and cleaning of the unit. Malfunctioning components may be easily replaced with new ones, and the entire unit may be replaced with another unit of the same or different performance parameters. The air handler may be used in a stand-alone quick chill and thaw system or in combination with existing refrigerators to convert, or retrofit, refrigerator compartments or drawers to quick chill and thaw chambers.

With proper dimensioning of the airflow paths, the size of the opening through the mullion center wall, and fan selection, the air handler is capable of rapidly chilling items in the pan at least four times faster than known refrigerators without freezing the items. Further, items may be defrosted in the pan much more rapidly than in conventional refrigerators, while keeping the items refrigerated. Conventional monitoring of the thawing process by the consumer is therefore avoided. Thus, a convenient combination rapid chill and defrost system is provided in a single pan with minimal impact on fresh food compartment storage space.

DETAILED DESCRIPTION OF THE INVENTION

Figure 1:
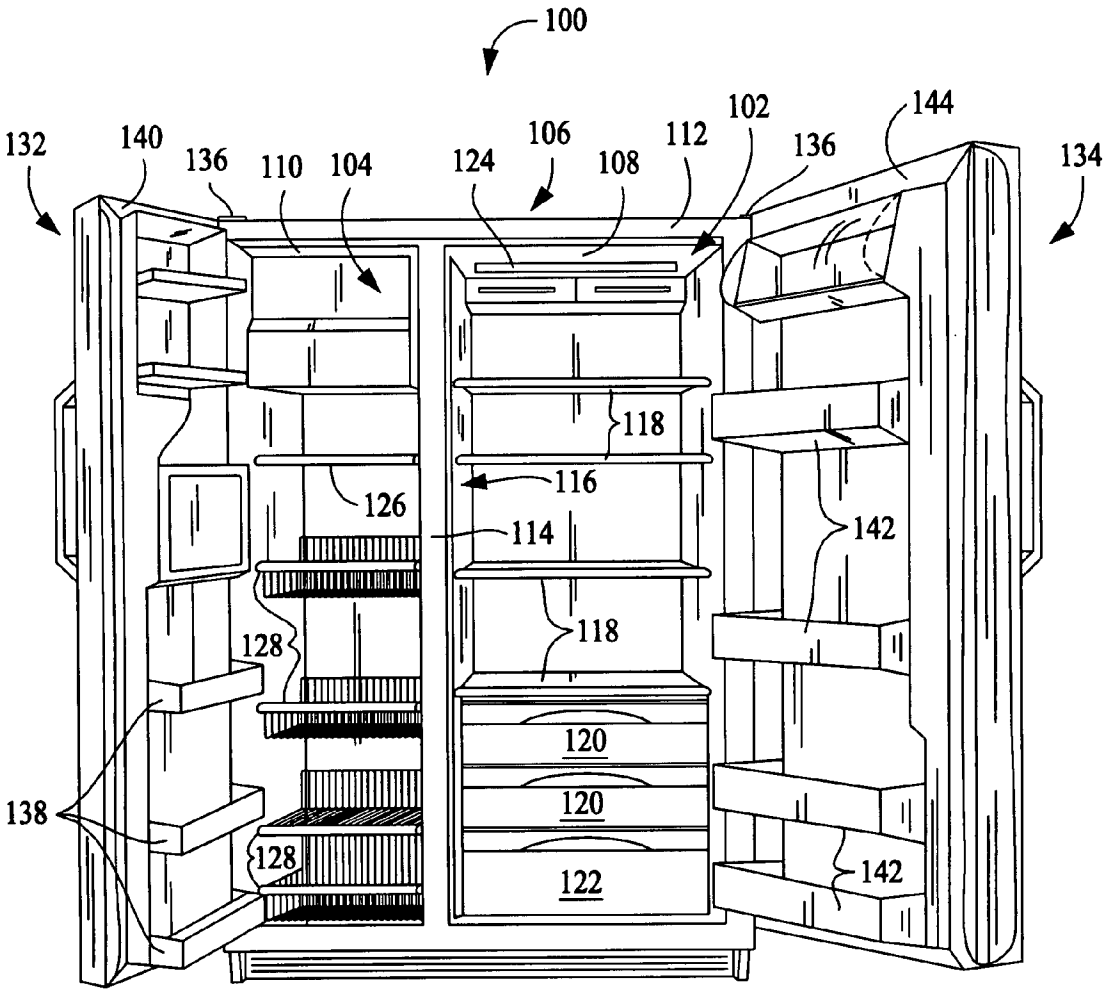
FIG. 1 is a perspective view of a refrigerator including a quick chill system.

FIG. 1 illustrates a side-by-side refrigerator 100 including a fresh food storage compartment 102 and freezer storage compartment 104. Fresh food compartment 102 and freezer storage compartment 104 are arranged side-by-side. A side-by-side refrigerator such as refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 106, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of the liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing a unitary finer into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of linen separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown in FIG. 1) described in detail below and selectively controlled, together with other refrigerator features, by a microprocessor (not shown in FIG. 1) according to user preference via manipulation of a control interface 124 mounted in an upper region of fresh food storage compartment 102 and coupled to the microprocessor. Shelves 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
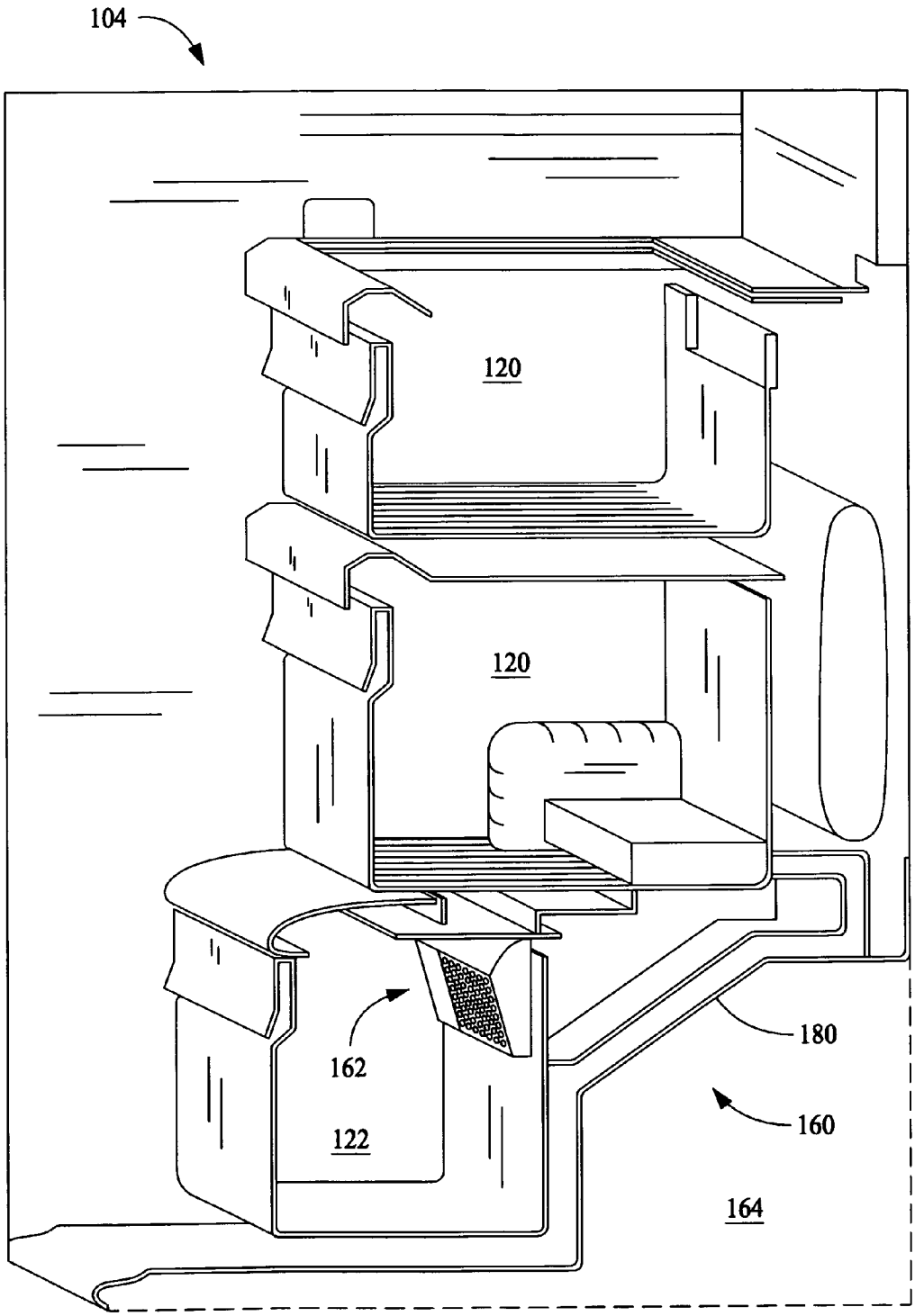
FIG. 2 is a partial perspective cut away view of a portion of FIG. 1.

FIG. 2 is a partial cutaway view of fresh food compartment 102 illustrating storage drawers 120 stacked upon one another and positioned above a quick chill and thaw system 160. Quick chill and thaw system 160 includes an air handler 162 and pan 122 located adjacent a pentagonal-shaped machinery compartment 164 (shown in phantom in FIG. 2) to minimize fresh food compartment space utilized by quick chill and thaw system 160. Storage drawers 120 are conventional slide-out drawers without internal temperature control. A temperature of storage drawers 120 is therefore substantially equal to an operating temperature of fresh food compartment 102. Quick chill and thaw pan 122 is positioned slightly forward of storage drawers 120 to accommodate machinery compartment 164, and air handler 162 selectively controls a temperature of air in pan 122 and circulates air within pan 122 to increase heat transfer to and from pan contents for timely thawing and rapid chilling, respectively, as described in detail below. When quick thaw and chill system 160 is inactivated, pan 122 reaches a steady state at a temperature equal to the temperature of fresh food compartment 102, and pan 122 functions as a third storage drawer. In alternative embodiments, greater or fewer numbers of storage drawers 120 and quick chill and thaw systems 160, and other relative sizes of quick chill pans 122 and storage drawers 120 are employed.

In accordance with known refrigerators, machinery compartment 164 at least partially contains components for executing a vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments.

Figure 3:
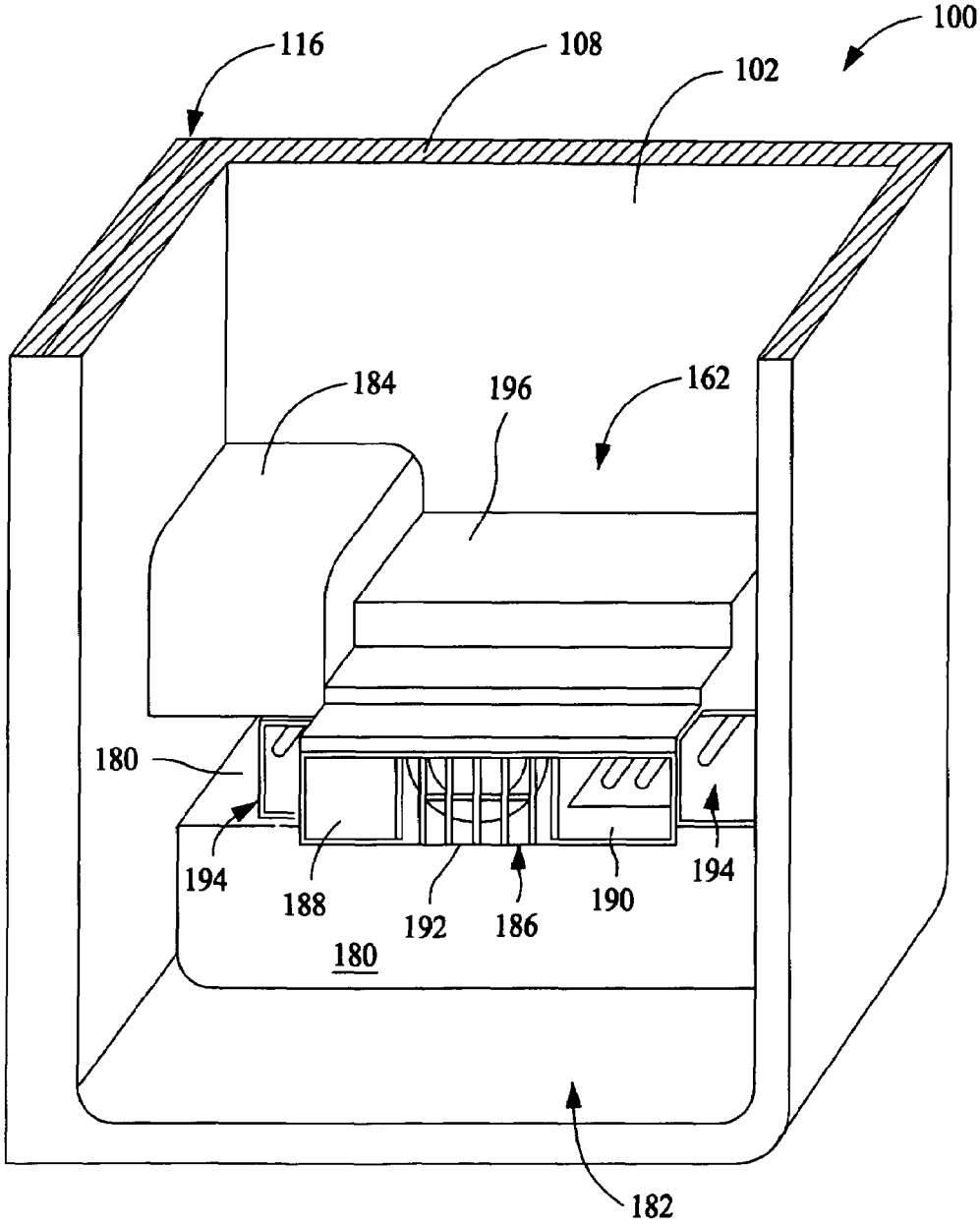
FIG. 3 is a partial perspective view of a portion of the refrigerator shown in FIG. 1 with an air handler mounted therein.

FIG. 3 is a partial perspective view of a portion of refrigerator 100 including air handler 162 mounted to fresh food compartment liner 108 above outside walls 180 of machinery compartment 164 (shown in FIG. 2) in a bottom portion 182 of fresh food compartment 102. Cold air is received from and returned to a freezer compartment bottom portion (not shown in FIG. 3) through an opening (not shown) in mullion center wall 116 and through supply and return ducts (not shown in FIG. 3) within supply duct cover 184. The supply and return ducts within supply duct cover 184 are in flow communication with an air handler supply duct 186, re-circulation duct 188 and a return duct 190 on either side of air handler supply duct 186 for producing forced air convection flow throughout fresh food compartment bottom portion 182 where quick chill and thaw pan 122 (shown in FIGS. 1 and 2) is located. Supply duct 186 is positioned for air discharge into pan 122 at a downward angle from above and behind pan 122 (see FIG. 2), and a vane 192 is positioned in air handler supply duct 186 for directing and distributing air evenly within quick chill and thaw pan 122. Light fixtures 194 are located on either side of air handler 162 for illuminating quick chill and thaw pan 122, and an air handler cover 196 protects internal components of air handler 162 and completes air flow paths through ducts 186, 188, and 190. In alternative embodiment, one or more integral light sources are formed into one or more of air handler ducts 186, 188, 190 in lieu of externally mounted light fixtures 194.

In an alternative embodiment, air handler 162 is adapted to discharge air at other locations in pan 122, so as, for example, to discharge air at an upward angle from below and behind quick chill and thaw pan 122, or from the center or sides of pan 122. In another embodiment, air handler 162 is directed toward a quick chill pan 122 located elsewhere than a bottom portion 182 of fresh food compartment 102, and thus converts, for example, a middle storage drawer into a quick chill and thaw compartment. Air handler 162 is substantially horizontally mounted in fresh food compartment 102, although in alternative embodiments, air handler 162 is substantially vertically mounted. In yet another alternative embodiment, more than one air handler 162 is utilized to chill the same or different quick chill and thaw pans 122 inside fresh food compartment 102. In still another alternative embodiment, air handler 162 is used in freezer compartment 104 (shown in FIG. 1) and circulates fresh food compartment air into a quick chill and thaw pan to keep contents in the pan from freezing.

Figure 4:
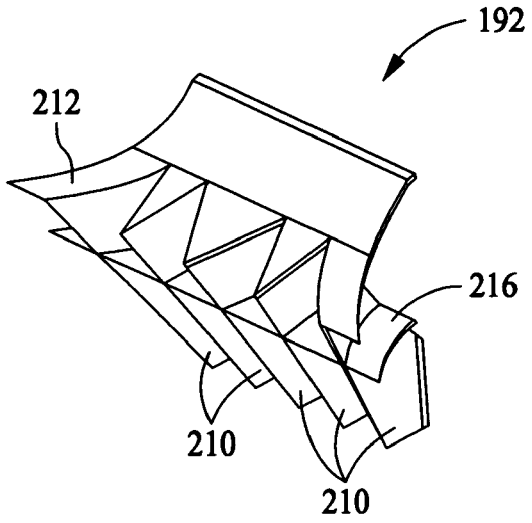
FIG. 4 is a perspective view of a vane for use with the air handler shown in FIG. 3.

FIG. 4 is a perspective view of vane 192 for directing air flow discharge from air handler supply duct 186 (shown in FIG. 3) to improve performance of quick chill and thaw system 160 (shown in FIG. 2) by facilitating an optimal air flow through quick chill and thaw pan 122 (shown in FIG. 2). Vane 192 includes a plurality of substantially longitudinal fins 210 oriented relative to one another to produce optimal airflow inside pan 122 and extending between a vane top surface 212 and a vane bottom surface 214. A lateral fin cross member 216 extends a distance below vane top surface 212 to reinforce longitudinal fins 210 and further produce desirable airflow in quick chill and thaw pan 122.

Figure 5:
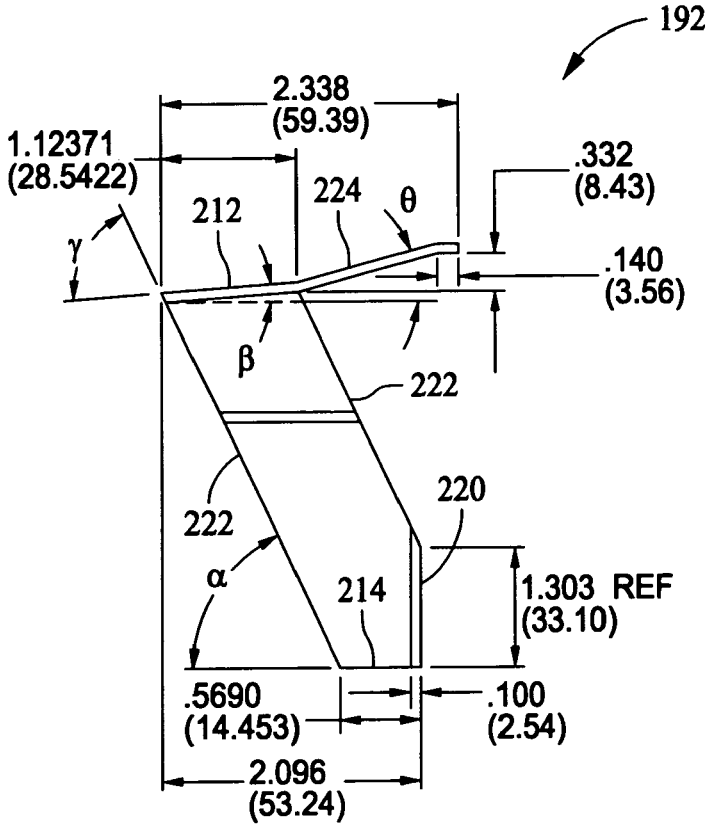
FIG. 5 is a side elevational view of the vane shown in FIG. 4.

FIG. 5 is a side elevational view of vane 192 including a rear edge 220 substantially perpendicular to vane bottom surface 214, a pair of substantially parallel side edges 222 extending obliquely from bottom surface 214 and rear edge 220 to vane top surface 212 at a negative slope and at an angle $\alpha$ with respect to vane bottom surface 214. Lateral fin 216 extends between side edges 222 and substantially parallel to vane bottom surface 214. Vane top surface 212 extends between side edges 222 with a positive slope and at an angle $\beta$ with respect to vane bottom surface 214, or alternatively at an angle $\gamma$ with respect to side edges 222. A ramped surface 224 extends obliquely from vane top surface 212 at a positive slope and at an angle $\theta$ with respect to vane bottom surface 214. In one embodiment of the invention $\alpha$ is substantially 65.0°, $\beta$ is substantially 6.75°, $\gamma$ is substantially 70.8°, and $\theta$ is substantially 17.2°. In alternative embodiments, one or more of $\alpha$, $\beta$, $\gamma$ and $\theta$ is greater or lesser than the stated value to adjust airflow in quick chill and thaw pan. Exemplary dimensions are also set forth in FIG. 5 in inches, and in millimeters in brackets.

Figure 6:
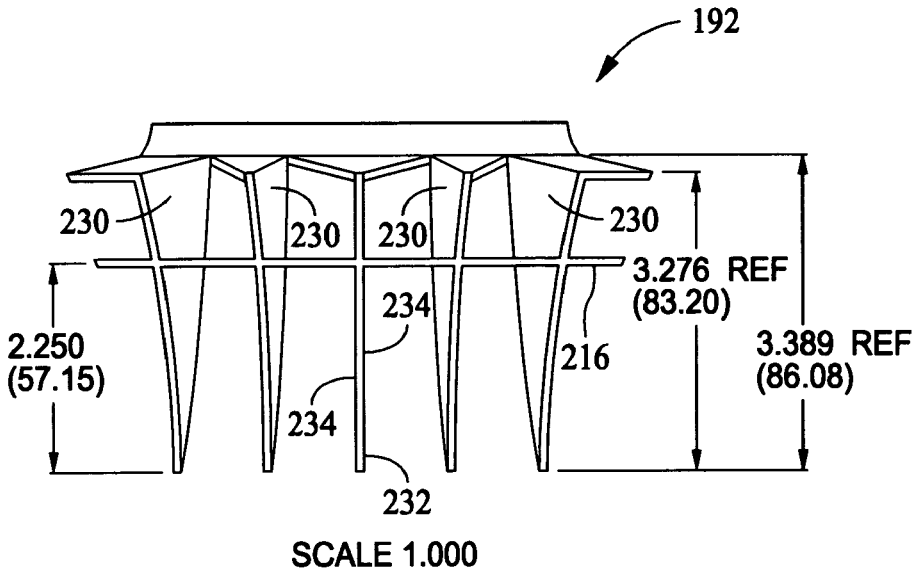
FIG. 6 is a front elevational view of the vane shown in FIG. 4.

FIG. 6 is a front elevational view of vane 192 illustrating contoured fin surfaces 230 extending away from a center fin 232 having opposite flat sides 234. Contoured fin surfaces 230 direct air outwardly from center fin 232 to disperse air laterally as it passed through vane 192. Alternative embodiments include greater or fewer than the five longitudinal fins 210 and one lateral fin 216 shown in FIG. 6 to adjust airflow of quick chill and thaw system 160. Exemplary dimensions are also set forth in FIG. 6 in inches, and in millimeters in brackets.

Figure 7:
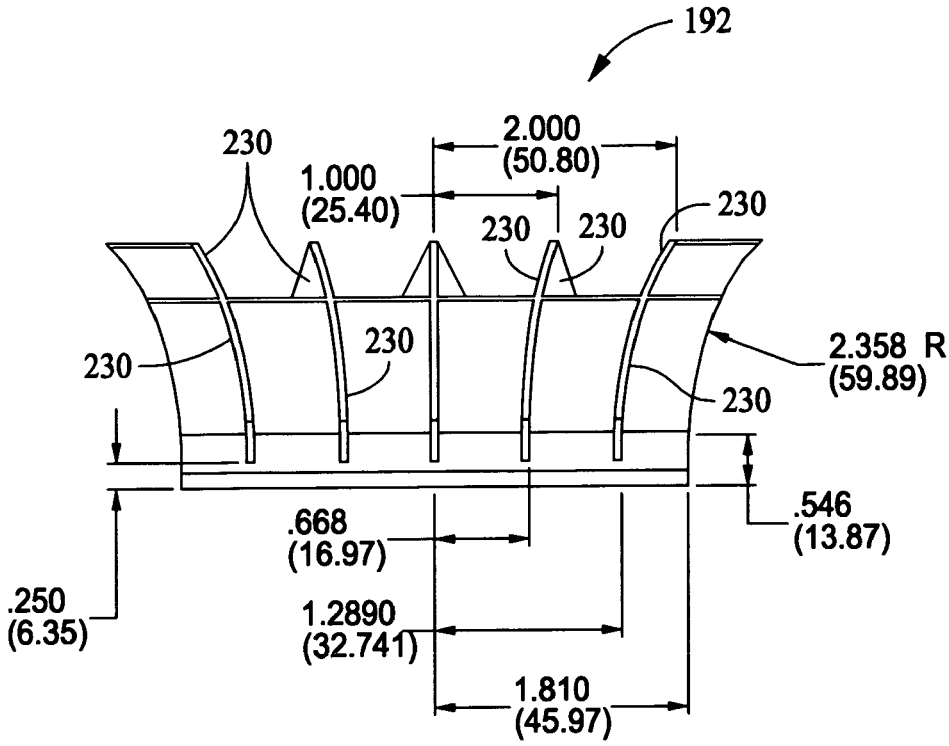
FIG. 7 is a bottom plan view of the vane shown in FIG. 4.

FIG. 7 is a bottom plan view of vane 192 illustrating contoured fin surfaces 230 for diffusing airflow therebetween, together with exemplary dimensions that may be varied in alternative embodiments.

Figure 8:
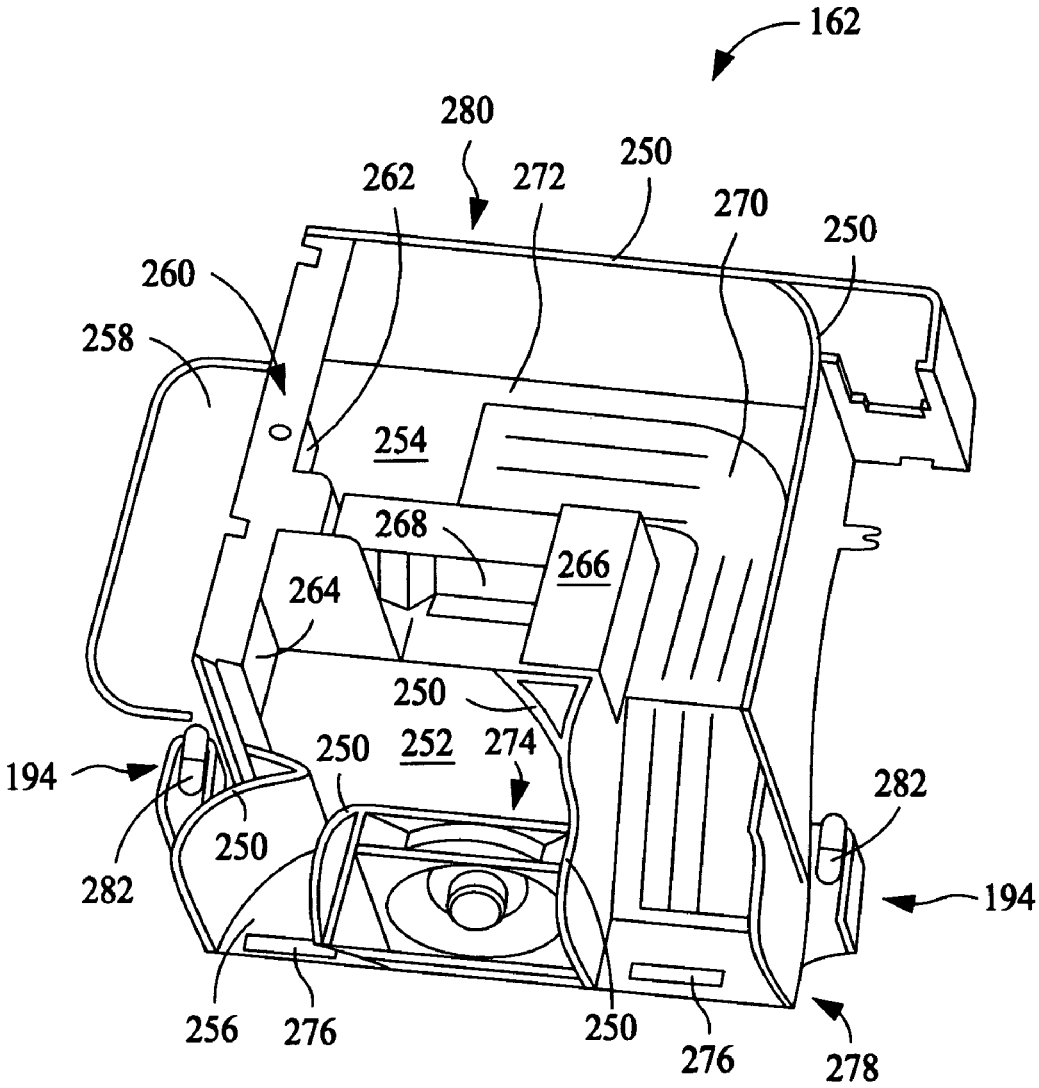
FIG. 8 is a partial perspective view of the air handler shown in FIG. 3.

FIG. 8 is a top perspective view of air handler 162 with air handler cover 196 (shown in FIG. 3) removed. A plurality of straight and curved partitions 250 at least partially define a passageway including an air supply flow path 252, a return flow path 254, and/or a re-circulation flow path 256. A duct cavity member base 258 is situated adjacent a conventional dual damper element 260 for opening and closing access to return path 254 and supply path 252 through respective return and supply airflow ports 262, 264 respectively. A conventional single damper element 266 opens and closes access between return path 254 and supply path 252 through an airflow port 268, thereby selectively converting return path 254 to an additional re-circulation path as desired for air handler thaw and/or quick chill modes. A heater element 270 is attached to a bottom surface 272 of recirculation path 256 for warming air in a quick thaw mode, and a fan 274 is provided in supply path 252 for drawing air from supply path 252 and forcing air into quick chill and thaw pan 122

(shown in FIG. 2) at a specified volumetric flow rate through vane 192 (shown in FIGS. 3–7) located downstream from fan 274 for dispersing air entering quick chill and thaw pan 122. Temperature sensors 276 are located in flow communication with recirculation path 256 and/or return path 254 and are operatively coupled to a microprocessor (not shown in FIG. 8) which is, in turn, operatively coupled to damper elements 260, 266, fan 274, and heater element 270 for temperature-responsive operation of air handler 162.

A forward portion 278 of air handler 162 is sloped downwardly from a substantially flat rear portion 280 to accommodate sloped outer wall 180 of machinery compartment 164 (shown in FIG. 2) and to discharge air into quick chill and thaw pan 122 at a slight downward angle. In one embodiment, light fixtures 194 and light sources 282, such as conventional light bulbs are located on opposite sides of air handler 162 for illuminating quick chill and thaw pan 122. In alternative embodiments, one or more light sources are located internal to air handler 162.

Air handler 162 is modular in construction, and once air handler cover 196 is removed, single damper element 266, dual damper element 260, fan 274, vane 192 (shown in FIGS. 3–7), heater element 270 and light fixtures 194 are readily accessible for service and repair. Malfunctioning components may be simply be pulled from air handler 162 and quickly replaced with functioning ones. In addition, the entire air handler unit may be removed from fresh food compartment 102 (shown in FIG. 2) and replaced with another unit with the same or different performance characteristics. In this aspect of the invention, an air handler 162 could be inserted into an existing refrigerator as a kit to convert an existing storage drawer or compartment to a quick chill and thaw system.

Figure 9:
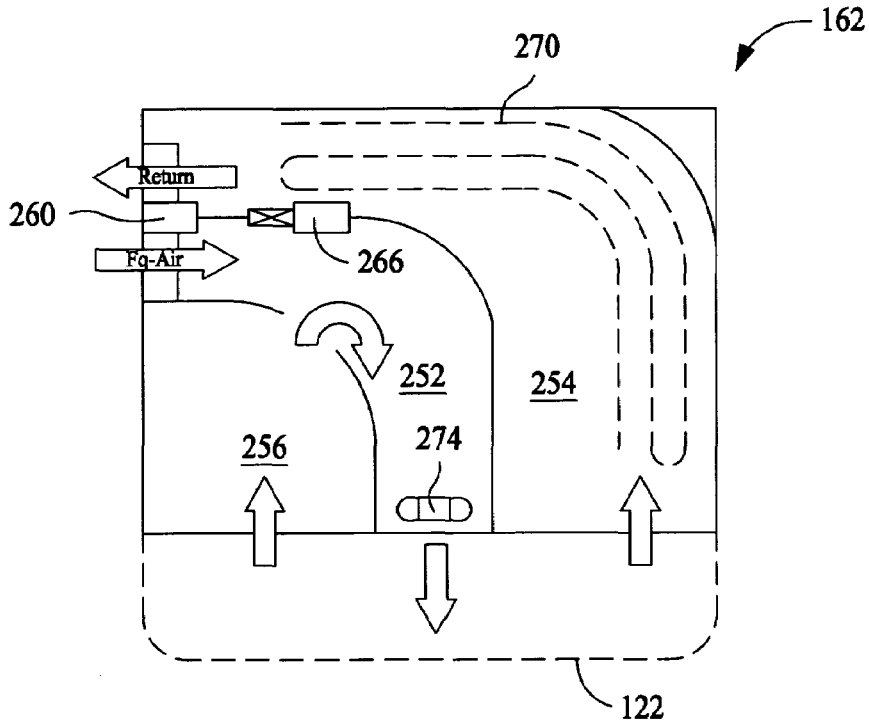
FIG. 9 is a functional schematic of the air handler shown in FIG. 8 in a quick chill mode.

FIG. 9 is a functional schematic of air handler 162 in a quick chill mode. Dual damper element 260 is open, allowing cold air from freezer compartment 104 (shown in FIG. 1) to be drawn through an opening (not shown) in mullion center wall 116 (shown in FIGS. 1 and 3) and to air handler air supply flow path 252 by fan 274. Fan 274 discharges air from air supply flow path 252 to pan 122 (shown in phantom in FIG. 9) through vane 192 (shown in FIGS. 3–7) for circulation therein. A portion of circulating air in pan 122 returns to air handler 162 via re-circulation flow path 256 and mixes with freezer air in air supply flow path 252 where it is again drawn through air supply flow path 252 into pan 122 via fan 274. Another portion of air circulating in pan 122 enters return flow path 254 and flows back into freezer compartment 104 through open dual damper element 260. Single damper element 266 is closed, thereby preventing airflow from return flow path 254 to supply flow path 252, and heater element 270 is de-energized.

In one embodiment, dampers 260 and 266 are selectively operated in a fully opened and fully closed position. In alternative embodiments, dampers 260 and 266 are controlled to partially open and close at intermediate positions between the respective fully open position and the fully closed position for finer adjustment of airflow conditions within pan 122 by increasing or decreasing amounts of freezer air and re-circulated air, respectively, in air handler supply flow path 252. Thus, air handler 162 may be operated in different modes, such as, for example, an energy saving mode, customized chill modes for specific food and beverage items, or a leftover cooling cycle to quickly chill meal leftovers or items at warm temperatures above room temperature. For example, in a leftover chill cycle, air handler may operate for a selected time period with damper 260 fully closed and damper 266 fully open, and then gradually closing damper 266 to reduce re-circulated air and opening damper 266 to introduce freezer compartment air as the leftovers cool, thereby avoid undesirable temperature effects in freezer compartment 104 (shown in FIG. 1). In a further embodiment, heater element 270 is also energized to mitigate extreme temperature gradients and associated effects in refrigerator 100 (shown in FIG. 1) during leftover cooling cycles and to cool leftovers at a controlled rate with selected combinations of heated air, unheated air, and freezer air circulation in pan 122.

It is recognized, however, that because restricting the opening of damper 266 to an intermediate position limits the supply of freezer air to air handler 162, the resultant higher air temperature in pan 122 reduces chilling efficacy.

Dual damper element airflow ports 262, 264 (shown in FIG. 8), single damper element airflow port 268 (shown in FIG. 8), and flow paths 252, 254, and 256 are sized and selected to achieve an optimal air temperature and convection coefficient within pan 122 with an acceptable pressure drop between freezer compartment 104 (shown in FIG. 1) and pan 122. In an exemplary implementation of the invention, fresh food compartment 102 temperature is maintained at about 37° F., and freezer compartment 104 is maintained at about 0° F. While an initial temperature and surface area of an item to be warmed or cooled affects a resultant chill or defrost time of the item, these parameters are incapable of control by quick chill and thaw system 160 (shown in FIG. 2). Rather, air temperature and convention coefficient are predominant controlled parameters of quick chill and thaw system 160 to chill or warm a given item to a target temperature.

In a specific embodiment of the invention, it was empirically determined that an average air temperature of 22° F. coupled with a convection coefficient of 6 BTU/hr.ft.$^{2}$° F. is sufficient to cool a six pack of soda to a target temperature of 45° or lower in less than about 45 minutes with 99% confidence, and with a mean cooling time of about 25 minutes. Because convection coefficient is related to volumetric flow rate of fan 274, a volumetric flow rate can be determined and a fan motor selected to achieve the determined volumetric flow rate. In a specific embodiment, a convention coefficient of about 6 BTU/hr.ft.$^{2}$° F. corresponds to a volumetric flow rate of about 45 ft$^3$/min. Because a pressure drop between freezer compartment 104 (shown in FIG. 1) and quick chill and thaw pan 122 affects fan output and motor performance, an allowable pressure drop is determined from a fan motor performance pressure drop versus volumetric flow rate curve. In a specific embodiment, a 92 mm, 4.5 W DC electric motor is employed, and to deliver about 45 ft$^3$/min of air with this particular motor, a pressure drop of less than 0.11 inches $H_2O$ is required.

Investigation of the required mullion center wall 116 opening size to establish adequate flow communication between freezer compartment 104 (shown in FIG. 1) and air handler 162 was plotted against a resultant pressure drop in pan 122. Study of the plot revealed that a pressure drop of 0.11 inches $H_2O$ or less is achieved with a mullion center wall opening having an area of about 12 in$^2$. To achieve an average air temperature of about 22° F. at this pressure drop, it was empirically determined that minimum chill times are achieved with a 50% mix of re-circulated air from pan 122 and freezer compartment 104 air. It was then determined that a required re-circulation path opening area of about 5 in$^2$ achieves a 50% freezer air/re-circulated air mixture in supply path at the determined pressure drop of 0.11 inches $H_2O$. A study of pressure drop versus a percentage of the previously determined mullion wall opening in flow communication with freezer compartment 104, or supply air, revealed that a mullion center wall opening area division of 40% supply and 60% return satisfies the stated performance parameters.

Thus, convective flow in pan 122 produced by air handler 162 is capable of rapidly chilling a six pack of soda more than four times faster than a typical refrigerator. Other items, such as 2 liter bottles of soda, wine bottles, and other beverage containers, as well as food packages, may similarly be rapidly cooled in quick chill and thaw pan 122 in significantly less time than required by known refrigerators.

As the above-described process of selecting performance parameters and determining system parameters is adaptable to achieve different performance objectives, and further because an alternative motor selection could vary a resultant required pressure drop and the remainder the of system parameters, the foregoing embodiment is described for illustrative purposes only and not by way of limitation.

Figure 10:
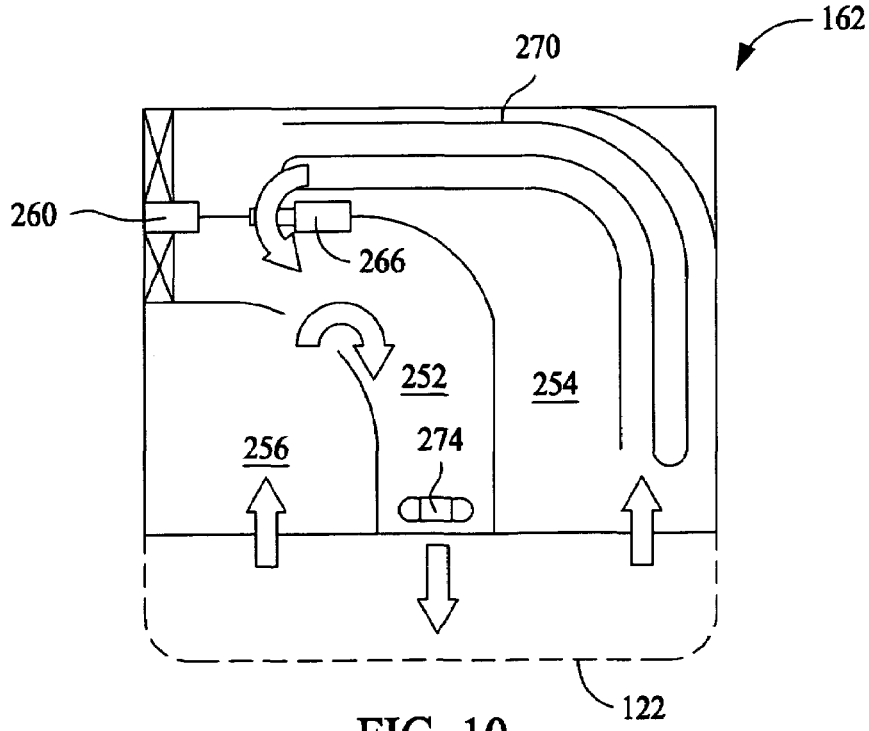
FIG. 10 is a functional schematic of the air handler shown in FIG. 8 in a quick thaw mode.

FIG. 10 is a functional schematic of air handler 162 shown in a thaw mode wherein dual damper element 260 is closed, heater element 270 is energized and single damper element 266 is open so that air flow in return path 254 is returned to supply path 252 and is drawn through supply path 252 into pan 122 by fan 274. Air also returns to supply path 252 from pan 122 via re-circulation path 256. Heater element 270, in one embodiment, is a foil-type heater element that is cycled on and off and controlled to achieve optimal temperatures for refrigerated thawing independent from a temperature of fresh food compartment 102. In other embodiments, other known heater elements are used in lieu of foil type heater element 274.

Heater element 270 is energized to heat air within air handler 162 to produce a controlled air temperature and velocity in pan 122 to defrost food and beverage items without exceeding a specified surface temperature of the item or items to be defrosted. That is, items are defrosted or thawed and held in a refrigerated state for storage until the item is retrieved for use. The user therefore need not monitor the thawing process at all.

In an exemplary embodiment, heater element 270 is energized to achieve an air temperature of about 40° to about 50°, and more specifically about 41° for a duration of a defrost cycle of selected length, such as, for example, a four hour cycle, an eight hour cycle, or a twelve hour cycle. In alternative embodiments, heater element 270 is used to cycle air temperature between two or more temperatures for the same or different time intervals for more rapid thawing while maintaining item surface temperature within acceptable limits. In further alternative embodiments, customized thaw modes are selectively executed for optimal thawing of specific food and beverage items placed in pan 122. In still further embodiments, heater element 270 is dynamically controlled in response to changing temperature conditions in pan 122 and air handler 162.

A combination rapid chilling and enhanced thawing air handler 162 is therefore provided that is capable of rapid chilling and defrosting in a single pan 122. Therefore, dual purpose air handler 162 and pan 122 provides a desirable combination of features while occupying a reduced amount of fresh food compartment space.

When air handler 162 is neither in quick chill mode nor thaw mode, it reverts to a steady state at a temperature equal to that of fresh food compartment 102. In a further embodiment, air handler 162 is utilized to maintain storage pan 122 at a selected temperature different from fresh food compartment 102. Dual damper element 260 and fan 274 are controlled to circulate freezer air to maintain pan 122 temperature below a temperature of fresh food compartment 102 as desired, and single damper element 266, heater element 270, and fan 274 are utilized to maintain pan 122 temperature above the temperature of fresh food compartment 102 as desired Thus, quick chill and thaw pan 122 may be used as a long term storage compartment maintained at an approximately steady state despite fluctuation of temperature in fresh food compartment 102.

Figure 11:
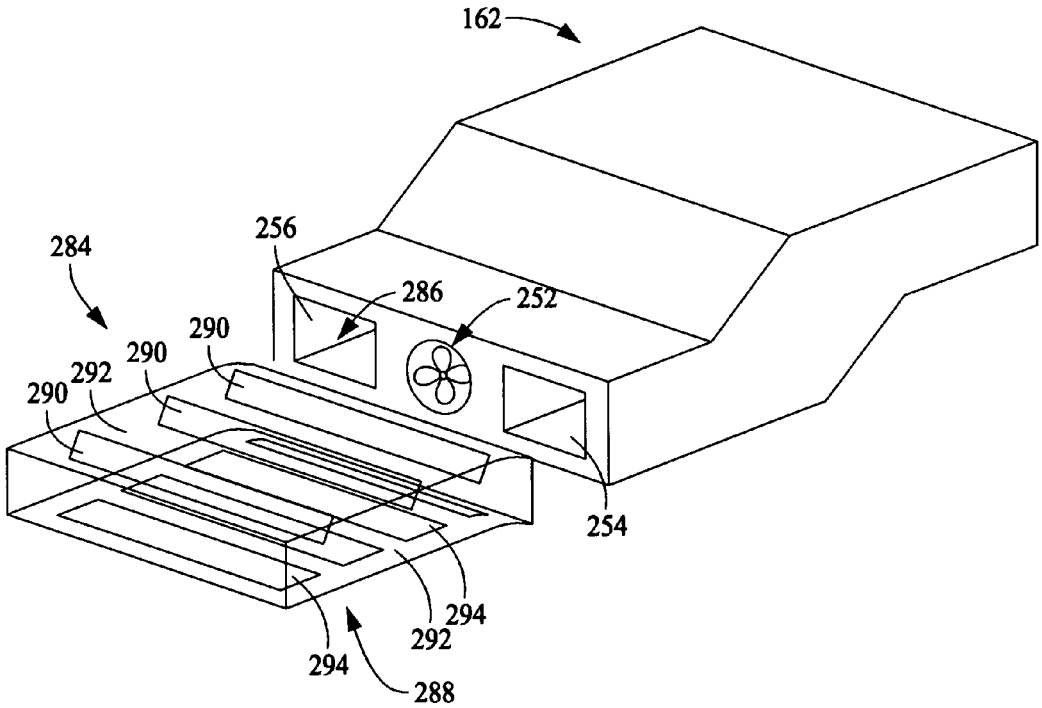
FIG. 11 is a perspective view of the air handler shown in FIG. 8 with a plenum extension.

FIG. 11 is a perspective view of air handler 162 with a plenum extension 284 in flow communication with air handler supply flow path 252 to receive air downstream of fan 274 for enhanced distribution into pan 122 (shown in FIG. 2). Plenum extension 284 includes a narrow mouth portion 286 positioned adjacent air handler supply flow path 252, and a wider exhaust portion 288 extending from mouth portion 286. Narrow mouth portion 286 establishes flow communication with air handler supply flow path 252 without substantially interfering with airflow into air handler return flow path 254 and re-circulation flow path 256. Sloped louvers 290 extend between side supports 292 of plenum extension 284 to direct air downward through elongated vents 294 positioned below louvers 290 and extending between plenum extension side supports 292.

Figure 12:
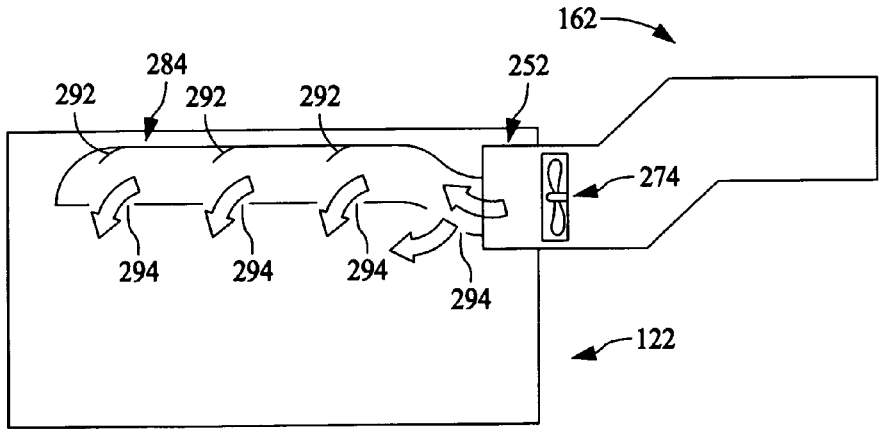
FIG. 12 is a schematic illustration of the air handler and plenum shown in FIG. 11.

FIG. 12 illustrates airflow through plenum extension 284 from air handler 162. Discharged air from air handler supply flow path 252 is directed by plenum extension mouth portion 286 to plenum extension exhaust portion 288. Once in exhaust portion 288, louvers 290 direct air downward through vents 294 and into pan 122 to produce a uniform air distribution in pan 122. In various embodiments, plenum extension 284 is coupled to air handler forward portion 278, pan 122 or another structural element in quick chill and thaw system 160 (shown in FIG. 2) or fresh compartment 102 (shown in FIG. 1) so as to establish flow communication with air handler supply flow path 252 when pan 122 is closed and quick chill and thaw system 160 is activated.

Figure 13:
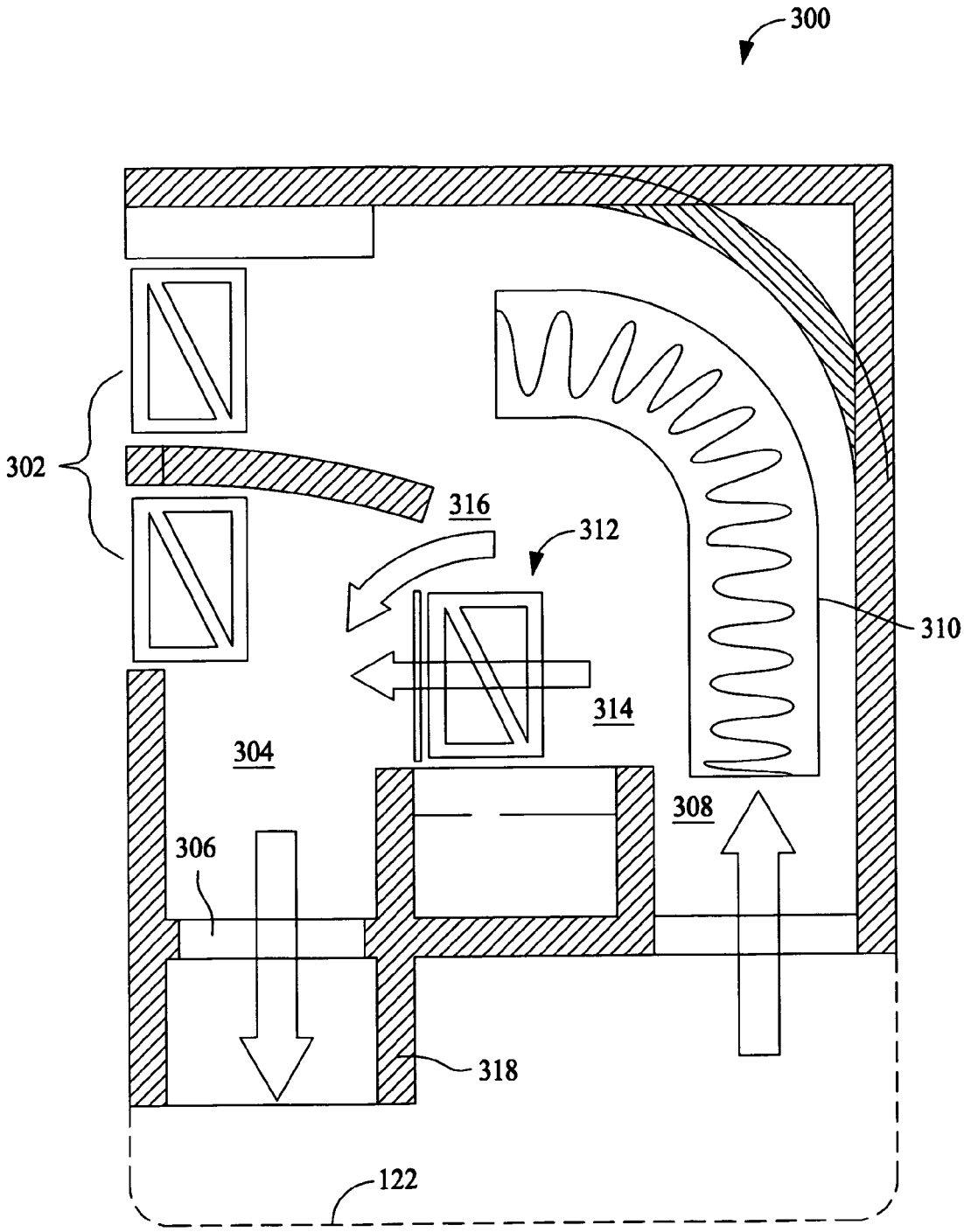
FIG. 13 is a functional schematic of another embodiment of an air handler in a quick thaw mode.

FIG. 13 is a functional schematic of another embodiment of an air handler 300 including a dual damper element 302 in flow communication with freezer compartment 104 air, a supply path 304 including a fan 306, a return path 308 including a heater element 310, a single damper element 312 opening and closing access to a primary re-circulation path 314, and a secondary re-circulation path 316 adjacent single damper element 312. Air is discharged from a side of air handler 300 as opposed to air handler 162 described above including a centered supply path 252 (see FIGS. 8–10), thereby forming a different, and at least somewhat unbalanced, airflow pattern in pan 122 relative to air handler 162 described above. Air handler 300 also includes a plenum extension 318 for improved air distribution within pan 122. Air handler 300 is illustrated in a quick thaw mode, but is operable in a quick chill mode by opening dual damper element 302. Notably, in comparison to air handler 162 (see FIGS. 9 and 10), return path 308 is the source of re-circulation air, as opposed to air handler 162 wherein air is re-circulated from the pan via a re-circulation path 256 separate from return path 254.

Figure 14:
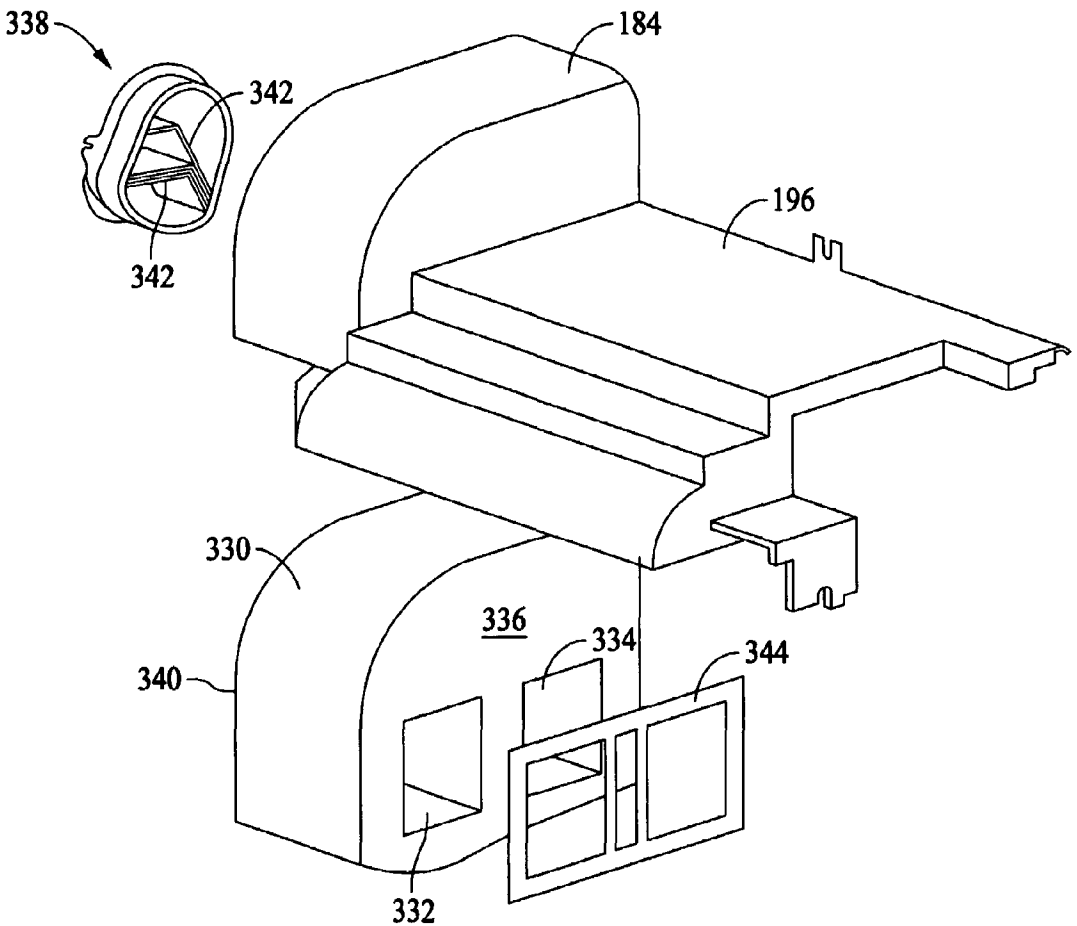
FIG. 14 is a perspective view of air exchange components for the air handler shown in FIG. 3.

FIG. 14 is a perspective view of air exchange components for air handler 162 (shown in FIGS. 2, 3, and 8) or 300 (shown in FIG. 13) including air handler cover 196 integrally fabricated with supply duct cover 184. Supply duct cover 184 houses a duct member 330 including supply and return ducts 332, 334 on a front end 336 placed in flow communication with air handler supply path 252 (shown in FIG. 8) and air handler return path 254 (also shown in FIG. 8). Duct member supply and return ducts 332, 334 communicate with a mullion center wall opening adapter 338 at a second end 340 of duct member 330. Mullion center wall opening adapter 338 is inserted into an opening (not shown) in mullion center wall 116 (shown in FIGS. 1 and 3) to establish supply and return flow communication between freezer compartment 104 (shown in FIG. 1) and air handler 162. Duct member opening adapter 338 includes divider elements 342 to appropriately apportion a percentage of mullion center wall opening area between supply and return ducts 332, 334 to accomplish quick chill and thaw system performance objectives. Duct member 330 seats in duct cavity member base 258 adjacent air handler dual damper element 302 (shown in FIG. 8), and a duct gasket 344 seals connection of duct member 330 to dual damper element 260.

Figure 15:
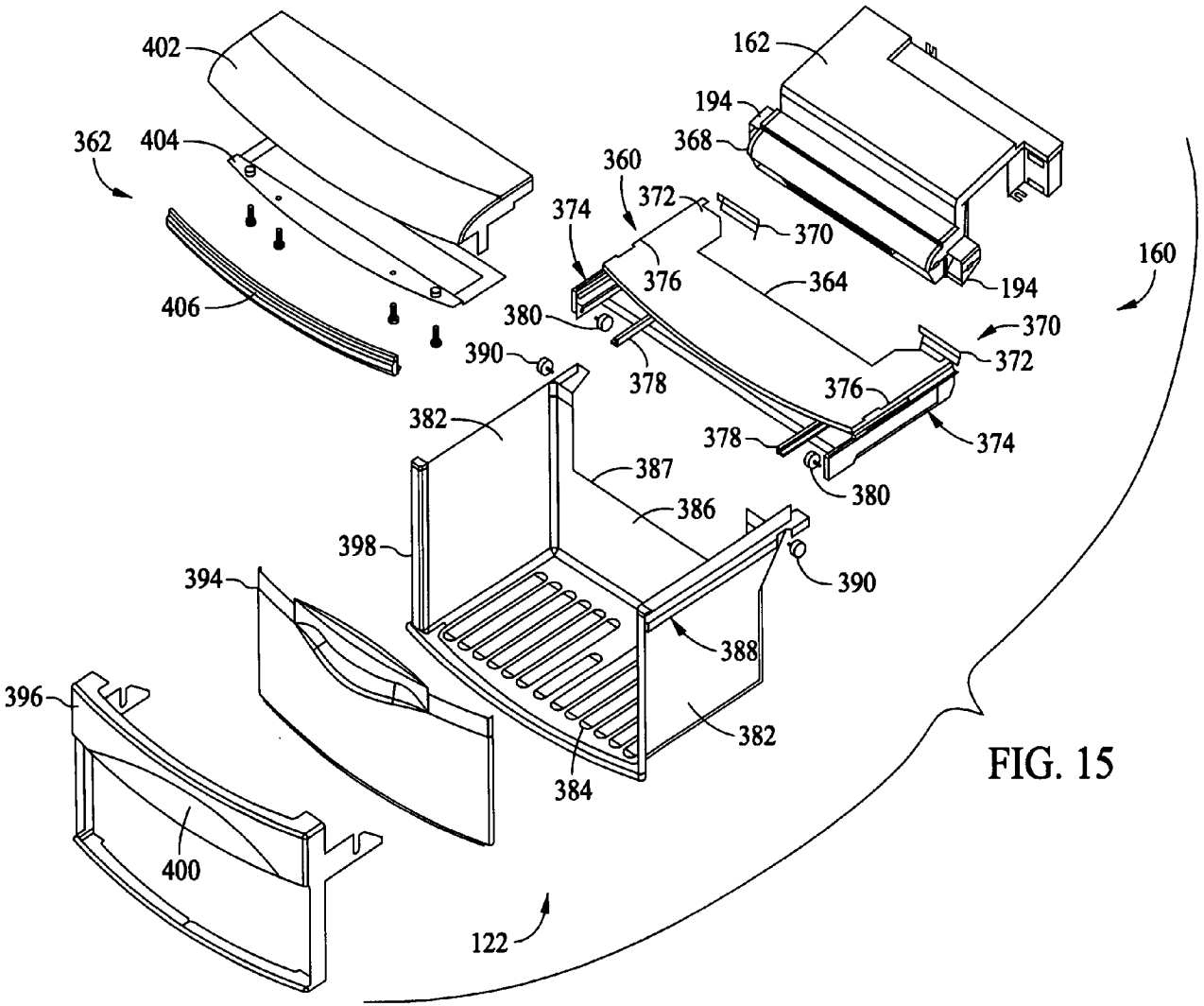
FIG. 15 is an exploded perspective view of the quick chill system shown in FIGS. 1 and 2.

FIG. 15 is an exploded perspective view of quick chill system 160 including air handler 162, a pan frame 360, pan 122, and a sliding cover assembly 362. Pan frame 360 is mounted to refrigerator compartment liner 108 adjacent air handler 162 and includes a cutout portion 364 for receiving a leading edge 368 of air handler 162. Rear gaskets 370 or seals are affixed between air handler lighting fixtures 194 and outermost rear edges 372 of frame cutout portion 364. Frame 360 also includes opposite and substantially parallel rail assemblies 374 depending from outer lateral edges 376 of frame cutout portion 364. Rail assemblies 374 include a pair of side seal compression members 378 for engagement with mounting ribs (not shown in FIG. 17) of each respective rail assembly 374, and each rail assembly 374 includes a wheel assembly 380 to facilitate slide-out extension of pan 122 relative to frame 360.

Pan 122 includes opposite side walls 382, a bottom wall 384 extending between side walls 382 and a rear wall 386 including a cutout portion 387 for receiving air handler leading edge 368. Pan side walls 382 each include an outwardly projecting slide member 388 and a wheel assembly 390 positioned at a rear end 392 thereof that cooperatively forms a slide rail system with pan frame rail assemblies 374. A window 394 fabricated from a transparent material is received in a cover 396 that is attached to a front 398 of pan 122. Cover 396 includes an outwardly curved handle 400 for user manipulation to selectively position pan 122 relative to stationary pan frame 360. Sliding cover assembly 362 includes a top cover 402, a plate seal member 404, and a front seal 406.

Figure 16:
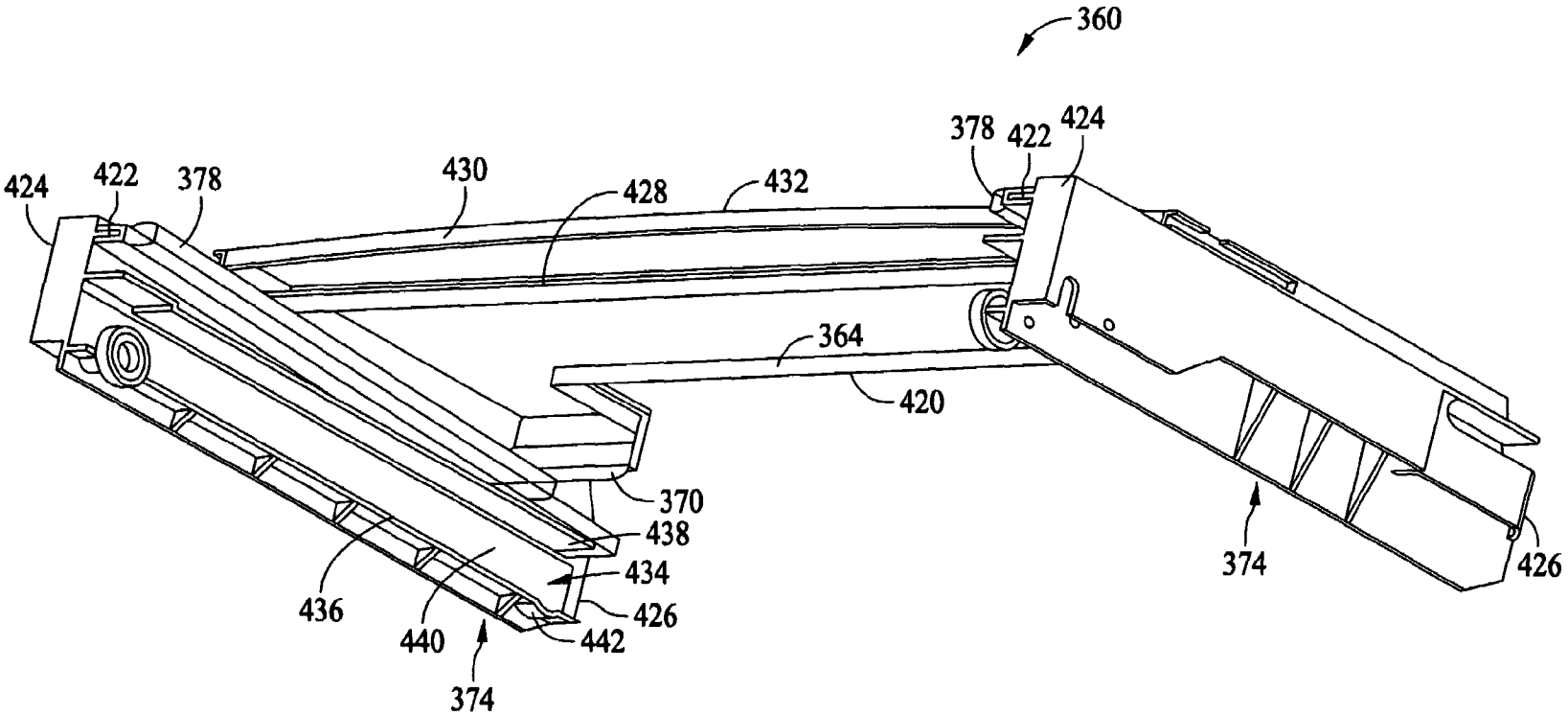
FIG. 16 is a perspective view of a quick chill pan frame shown in FIG. 15.

FIG. 16 illustrates pan frame 360 including a foam seal 420 affixed to frame cutout portion 364 to sealingly engage air handler 162 (shown in FIG. 15) and rear gaskets 370 sealingly engage air handler light fixtures 194 (shown in FIG. 15). Side seal compression members 378 are engaged to mounting ribs 422 which extend from a front 424 to a rear 426 of each rail assembly 374. Mounting ribs 422 are negatively sloped from front 424 to rear 426. That is, mounting ribs 422 are elevated at rail assembly front ends 424 relative to rail assembly rear ends 426. In a specific embodiment, mounting ribs 422, and hence side seal compression members 378 are sloped at about a 2.5° angle from front 424 to rear 426. A slide cover seal compression member 428 extends between rail assemblies 374 at a distance from a leading edge 430 of frame top surface 432.

Rail assemblies 374 include a wheel track 434 formed by a substantially horizontal bottom rail 436, a substantially horizontal top rail 438, and a substantially vertical side surface 440 extending therebetween. Track 434 is sized and dimensioned to receive pan wheel assembly 390 (shown in FIG. 17), and bottom rail 436 includes a rounded stop or catch 442 to maintain pan wheel assembly 390 in a closed position corresponding to a closed and sealed position of pan 122.

Figure 17:
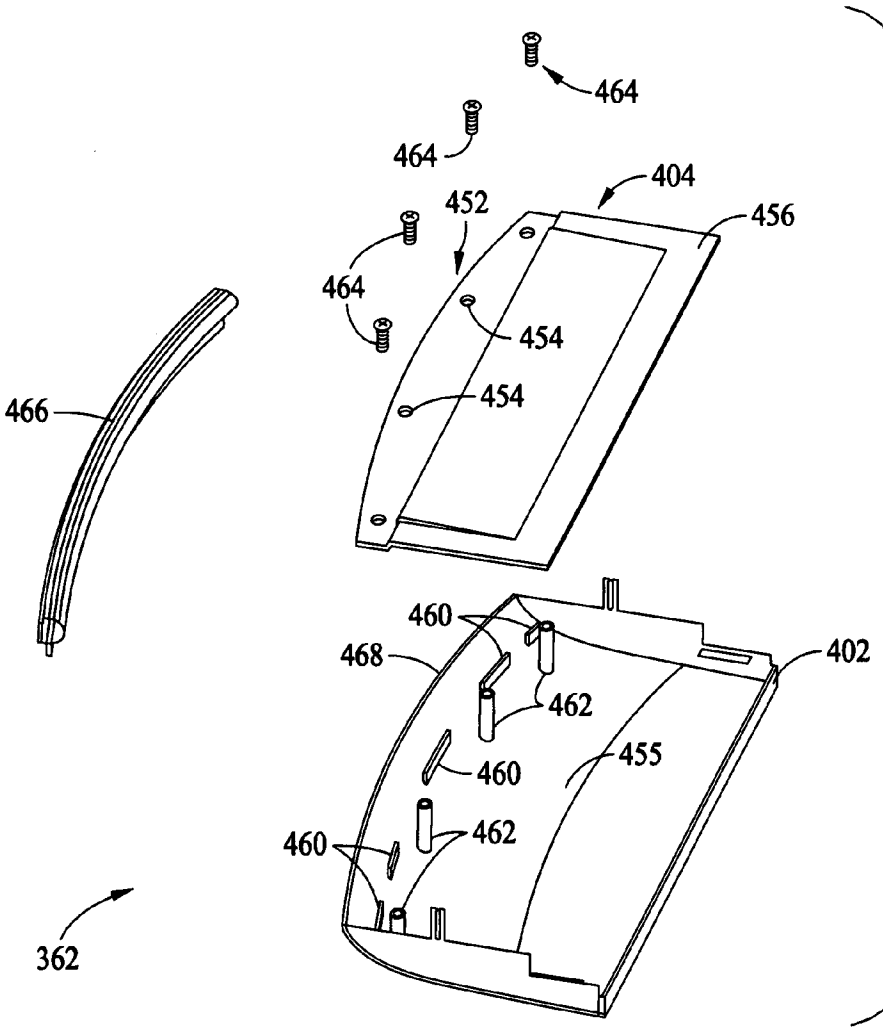
FIG. 17 is an exploded perspective view of a quick chill pan sliding cover shown in FIG. 15.

FIG. 17 illustrates sliding cover assembly 362 including a plate seal 404 including an arcuate leading edge 452 having a plurality of mounting apertures 454 therein, and a substantially rectangular portion 456 depending from leading edge 452. An inner surface 455 of top cover 402 includes a plurality of plate seal positioning tabs 460 and a plurality of stud mounts 462 for receiving attachment members 464 for securing plate seal 404 to top cover 402. In one embodiment, stud mounts 462 are threaded and attachment members 464 are screws. A front seal compression member 466 is engaged to a front lip 468 of top cover 402.

Figure 18:
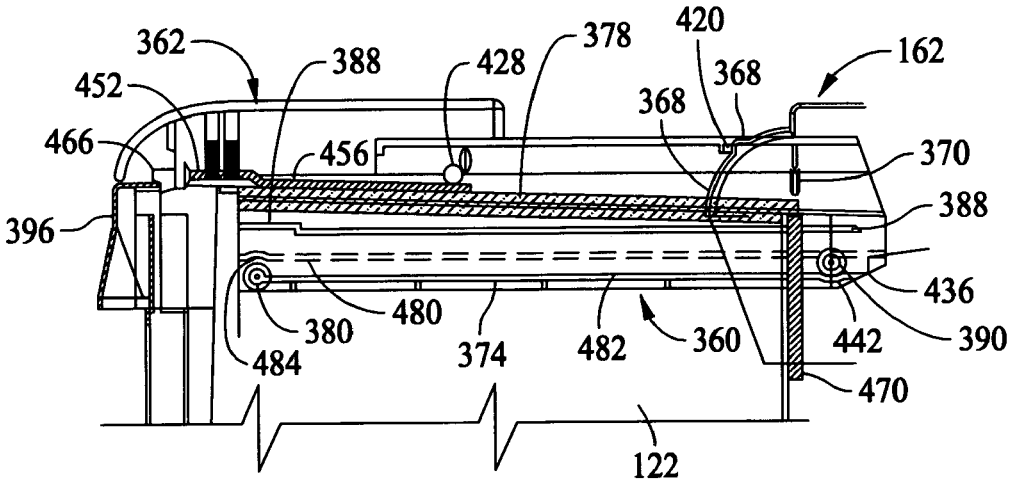
FIG. 18 is a functional schematic of an quick chill pan and frame assembly.

FIG. 18 is a functional schematic of a quick chill pan 122 and frame 360 in a closed position. Sliding cover assembly 362 is slidingly attached to frame 360 so that cover assembly front seal 466 is compressed by cover 396, thereby forming an airtight connection across a front of pan 122. Plate seal rectangular portion 456 extends from plate seal arcuate leading edge 452 at a slight angle and compresses side seals 378 to form an airtight connection on the sides of pan 122. Plate seal rectangular portion 456 also compresses slide cover seal 428 to form an airtight seal at a rear end of seal plate 404. Frame foam seal 420 abuts air handler leading edge 368, and rear gasket seals 370 sealingly engage air handler light fixtures 194 (not shown in FIG. 18). An air handler seal member 470 compliments frame foam seal 420 in providing a sealed engagement of air handler 162 and pan 122 when in the closed position. Thus, a sealed pan 122 is provided to efficiently and rapidly chill items placed in pan 122, thaw frozen items placed in pan 122, or maintain pan 122 at a desired temperature.

Pan 122 is suspended from frame 360 by cooperative action of frame rail assemblies 374 and pan slide members 388. Frame wheel assembly 380 contacts a bottom surface 480 of pan slide member 388, and pan wheel assembly 390 contacts a top surface 482 of frame bottom rail 436 so that wheel assemblies 380, 390 ride their respective surfaces so that pan 122 may be moved between open and closed positions. In the closed position, wheel assemblies 380, 390 rest in detents or catches 484, 442 in pan slide member 388 and frame bottom rail 436, respectively, to maintain pan 122 in the closed position.

Figure 19:
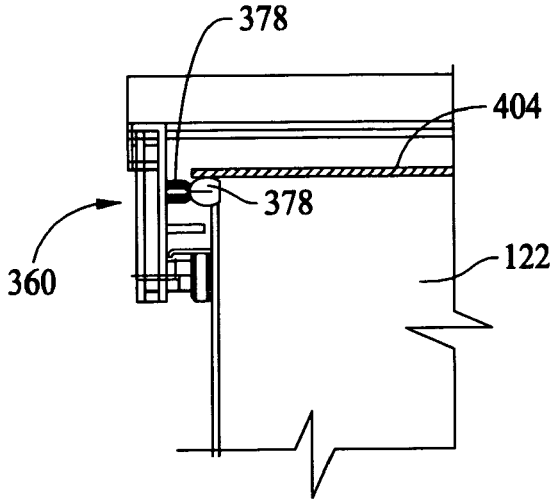
FIG. 19 is a partial cross sectional view of the chill pan and frame assembly in a closed position.

FIG. 19 is a partial cross sectional view of pan 122 and frame 360 in a closed position illustrating sliding cover assembly plate seal 404 contacting and compressing side seals 378.

Figure 20:
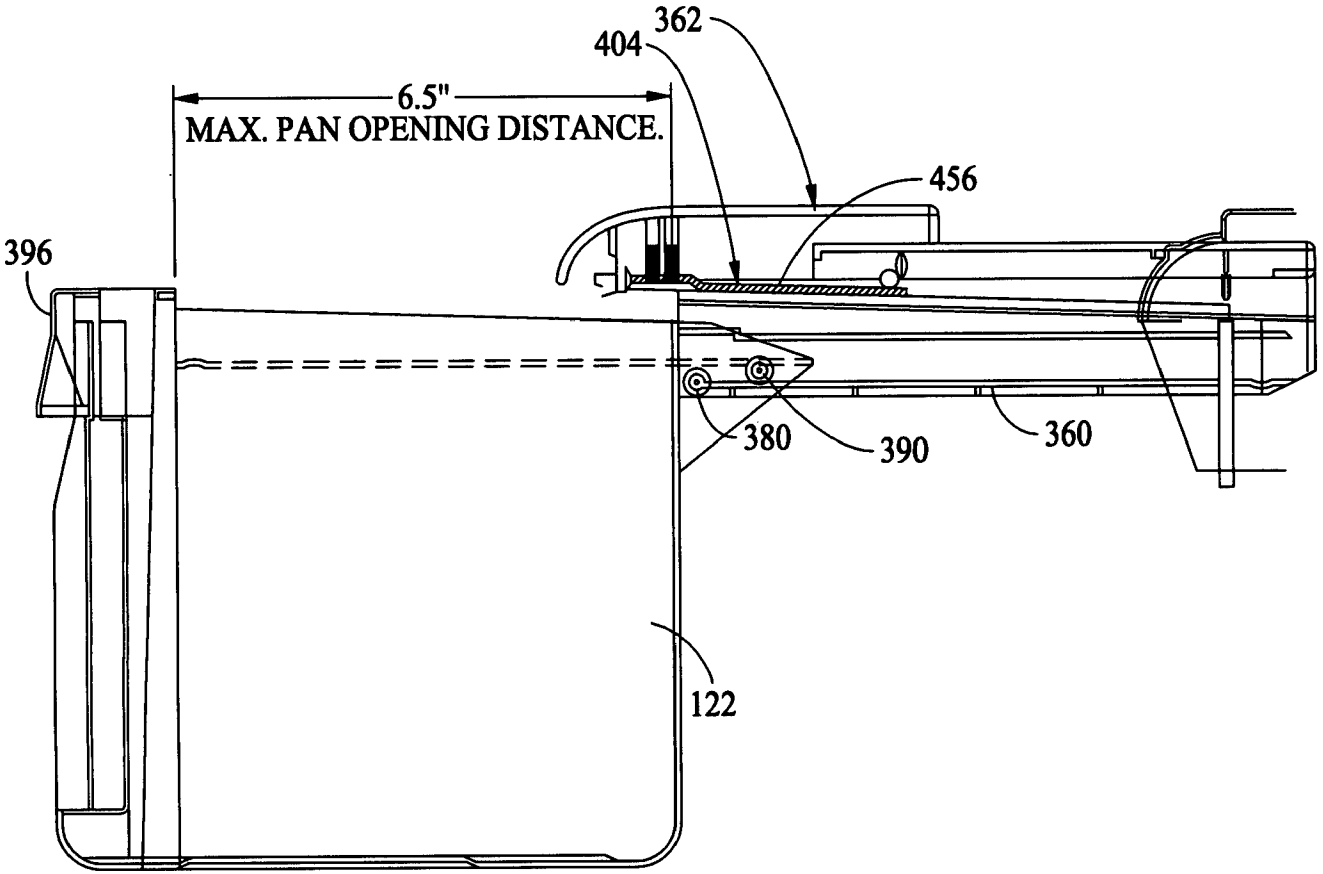
FIG. 20 is a functional schematic of the quick chill pan and frame assembly in an open position.

FIG. 20 is a functional schematic of quick chill pan 122 and frame 360 in an open position. A mechanical linkage (not shown) pulls sliding cover assembly 362 backward as pan 122 is moved forward to obtain access to pan 122. Thus, sliding cover assembly 362 retracts from pan front cover 396 as pan 122 is opened. In a specific embodiment, the mechanical linkage limits forward movement of pan 122 to about 4.25 inches, while at the same time causing sliding cover assembly 362 to be retracted about 2.25 inches in an opposite direction. A 6.25 inch pan access opening is therefore provided for loading or unloading of pan 122. The limited access opening, in one embodiment, prevents interference with shelves 142 of a fresh food compartment door 134 (shown in FIG. 1). In alternative embodiments, greater or lesser access openings are provided. When necessary or as desired for convenient cleaning, loading, or unloading, pan 122 is completely removed from frame 360 and food storage compartment 102 by lifting pan wheel assembly 390 over frame wheel assembly 380 when pan 122 is in a fully extended position.

As pan 122 is closed from an open position, the mechanical linkage causes sliding cover assembly 362 to move forward as pan 122 is moved backward into refrigerator 100. Sloped rectangular portion 456 of sliding cover plate seal 404 engages pan side seals 378 when pan 122 is displaced approximately 1.75 inches from its closed position, and side seals 378 are compressed by plate seal 404 as pan 122 is closed in the remaining 1.75 inches to the fully closed position described above in relation to FIG. 18.

Figure 21:
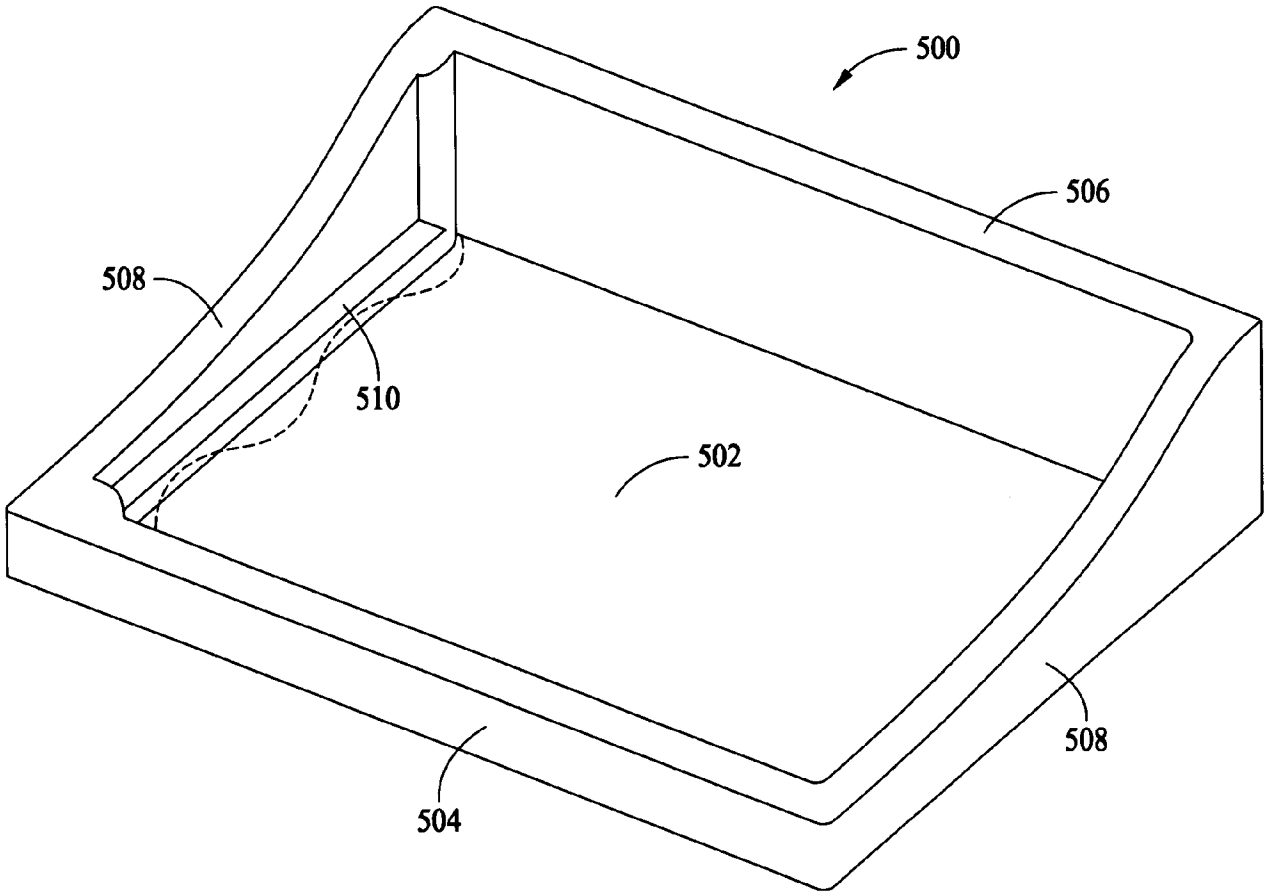
FIG. 21 is a perspective view of a quick chill tray for use with the quick chill system shown in FIGS. 1 and 2.

FIG. 21 is a perspective view of a quick chill tray 500 that improves quick chilling and thaw performance when inserted into pan 122 (shown in FIG. 15), as well as collects drippings and spills for easier cleaning of pan 122. A recessed tray bottom surface 502 is sloped from a tray front edge 504 rearward to a tray back edge 506 at about a 1° angle. Side walls 508 extend between front 504 and back 506 edges and gradually increase in height from front to back. Each side wall 508 also includes a ledge 510 for supporting a rack (not shown in FIG. 21).

Figure 22:
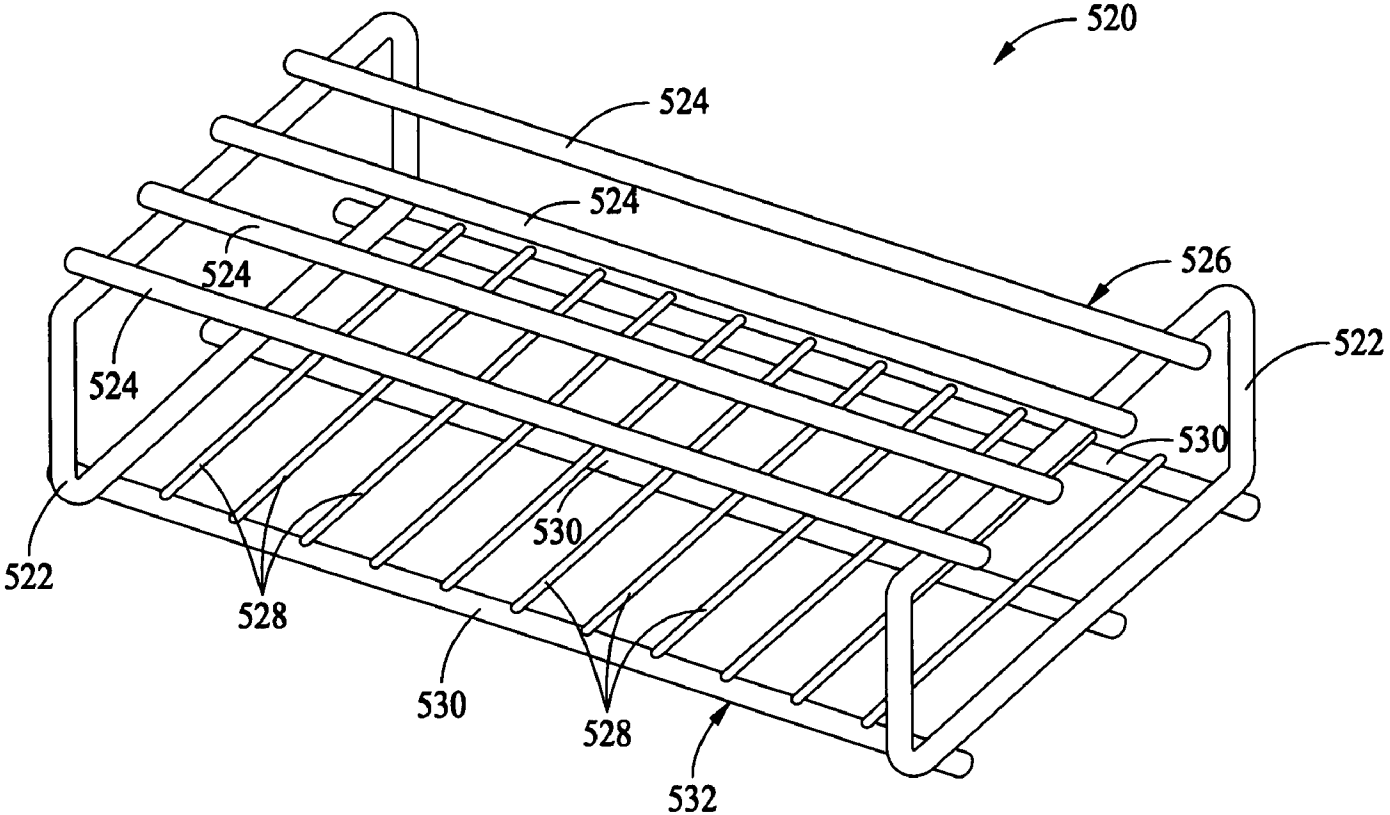
FIG. 22 is a perspective view of a quick chill rack for use with the quick chill system shown in FIGS. 1 and 2.
Figure 23:
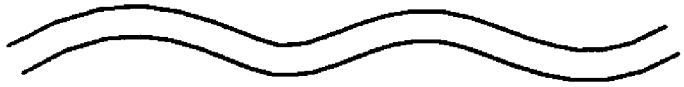
FIGS. 23–25 are partial views of alternative embodiments of a quick chill rack.
Figure 24:
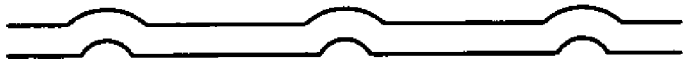
Figure 25:
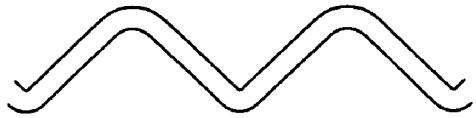

FIG. 22 is a perspective view of a quick chill rack 520 for use with quick chill tray 500 (shown in FIG. 21) to position items to be chilled above recessed tray bottom surface 502 (shown in FIG. 21). Rack 520 is a metal wire rack including two substantially rectangular ends 522, a plurality of longitudinally spaced apart wire members 524 extending between ends 522 on a first side 526, and a plurality of laterally extending wire members 528 attached to longitudinal members 530 on a second side 532. Items to be chilled, such as cans of soda, are placed on first side 526 and rest between longitudinal members 524. Items to be thawed, are supported on lateral wire members 528 of rack second side 532. Thus, a dual purpose rack 520 is provided that is inserted into tray 500 with the applicable side up to execute a quick chill or thaw feature of the present invention. It is contemplated that other geometrical structures are used in alternative embodiments to fine tune chilling or defrost results for preferred food and beverage items, included but not limited to curved wire members and non-linear portions of wire members between rack ends 522, such as, for example, a zig-zag pattern. Exemplary geometric configurations of wire members are illustrated in FIGS. 23–25.

Figure 26:
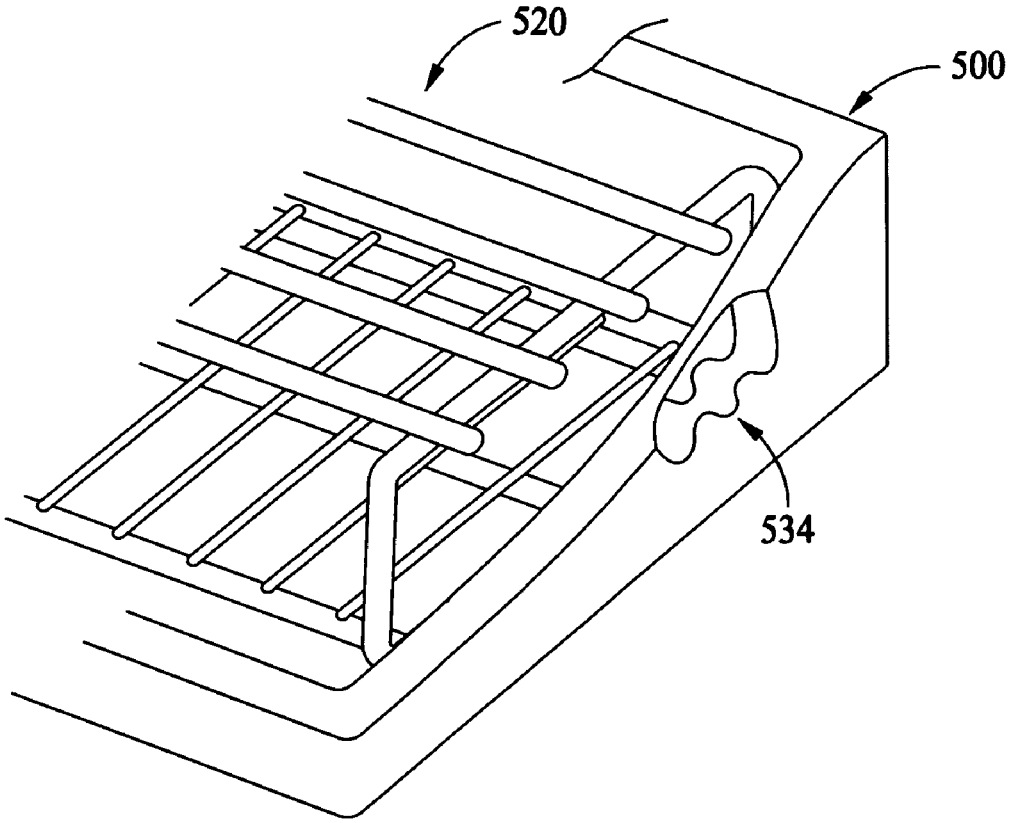
FIG. 26 is a partial perspective view of a quick chill tray and rack assembly.

FIG. 26 illustrates rack 520 (shown in FIG. 22) in conjunction with tray 500 (shown in FIG. 21). In one embodiment, tray 500 includes a handle 534 on tray side walls 508 for convenient lifting of tray 500 from pan 122 (shown in FIG. 15).

Figure 27:
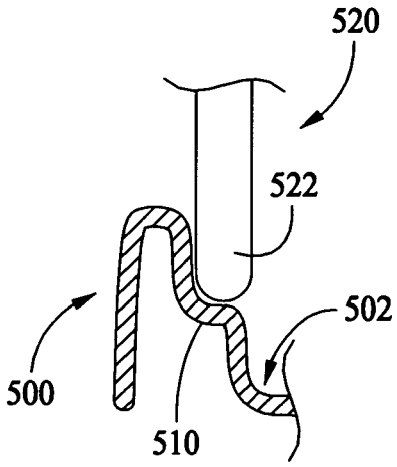
FIG. 27 is a partial cross sectional view of the quick chill tray and rack assembly shown in FIG. 26.

FIG. 27 is a partial cross sectional view of quick chill tray 500 and rack 520 illustrating rack end 522 resting upon side wall ledge 510 of tray 500. Therefore, rack 520 is supported above tray bottom surface 502 so that air may flow underneath rack 520 for improved airflow through pan 122.

Figure 28:
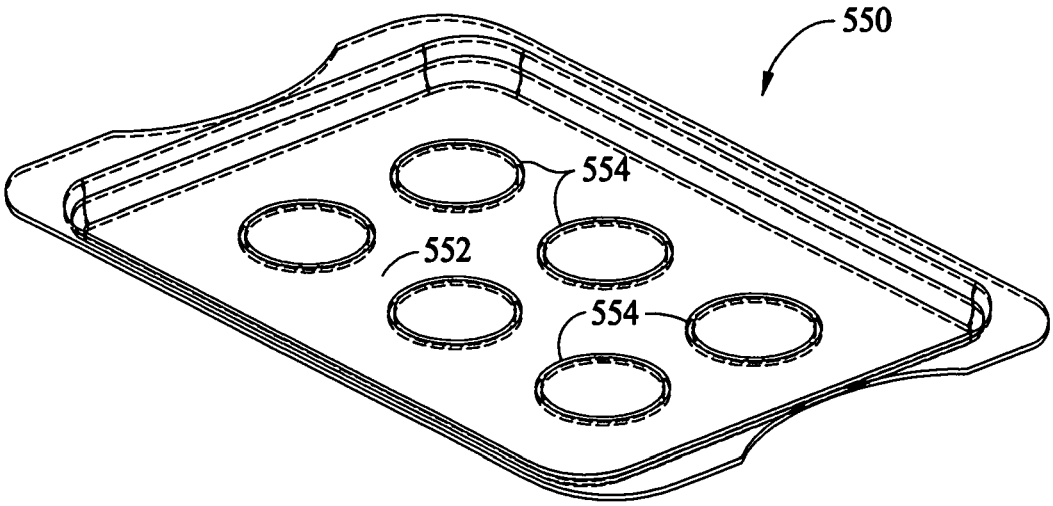
FIG. 28 is a perspective view of a second embodiment of a tray for the quick chill system shown in FIGS. 1 and 2.

FIG. 28 is a perspective view of a second embodiment of a tray 550 for insertion into pan 122 including a recessed bottom surface 552 including markers 554 for placement of, for example, soda cans, in a spaced apart manner that improves or optimizes air flow through pan 122. In one embodiment, markers 554 are recessed to facilitate positioning of cans and to maintain them in position. In alternative embodiments, other appropriate markers are used to guide placement of a variety of items and packages within pan 122.

While the invention has been described in terms of various specific embodiments, those skilled in the art will recognize that the invention can be practiced with modification within the spirit and scope of the claims.

What is claimed is:

1. A quick chill and thaw system for a refrigerator including a first compartment at a first temperature and a second compartment at a second temperature, said quick chill and thaw system comprising:

a pan;

an air handler comprising an air supply flow path, a fan positioned to move air through said air supply flow path from the first compartment and into said pan, a return flow path configured to return air from said pan to the first compartment, and a heater element positioned to warm air that passes through said air handler wherein at least one of said pan and said air handler comprises a light source for illuminating said pan; and a duct member adapted for establishing flow communication between said air supply flow path and an air supply from the second compartment, wherein the second compartment comprises a freezer compartment.

2. A quick chill and thaw system in accordance with claim 1 further comprising a re-circulation path for mixing air from said pan with air in said air supply flow path.

3. A quick chill and thaw system in accordance with claim 1 wherein said air handler is configured to deliver air into said pan from above and behind said pan.

4. A quick chill and thaw system in accordance with claim 1 wherein said pan comprises a sliding cover.

5. A quick chill and thaw system in accordance with claim 1 wherein said pan is configured for slide-out access.

6. A quick chill and thaw system in accordance with claim 1 wherein said duct member comprises a supply duct and a return duct.

7. A quick chill and thaw system in accordance with claim 1 further comprising an adapter for establishing flow communication between said air supply and said duct member, said adapter configured to apportion a percentage of the air flow to said air handler supply airflow path.

8. A quick chill and thaw system in accordance with claim 7 wherein said percentage is about 40%.

9. A quick chill and thaw system in accordance with claim 1 further comprising a tray in said pan.

10. A quick chill and thaw system in accordance with claim 9 wherein said tray includes markers for placement of items on said tray.

11. A quick chill and thaw system in accordance with claim 1 further comprising a rack for positioning items within said pan.

12. A quick chill and thaw system in accordance with claim 1 wherein said rack comprises a chill side and a thaw side.

13. A quick chill and thaw system in accordance with claim 1 wherein said air handler is adapted for rapid chilling and refrigerated thawing of items placed in said pan.

14. A quick chill and thaw system in accordance with claim 13 wherein said air handler is operable in a chill mode, said air handler configured to move air at a temperature of about 21° F. in said chill mode.

15. A quick chill and thaw system in accordance with claim 13 wherein said air handler is operable in a thaw mode, said air handler configured to move air at a temperature and velocity that maintains a surface temperature of a thawed item in a refrigerated state.

16. A quick chill and thaw system in accordance with claim 15 wherein said air handler is operable in said thaw mode for a selected period of time.

17. A quick chill and thaw system in accordance with claim 15 wherein said air temperature is between about 40° F. to about 50° F.

18. A quick chill and thaw system in accordance with claim 17 wherein said air temperature is about 41° F.

19. A quick chill and thaw system in accordance with claim 1 wherein said heater is positioned within said air handler.

20. A quick chill and thaw system in a refrigerator including a fresh food compartment and a freezer compartment, said quick chill and thaw system comprising:

a pan positioned within the fresh food compartment, the fresh food compartment maintained at a first temperature; and an air handler in flow communication with said pan, said air handler defining an air supply flow path and a return flow path; and a heater element positioned with respect to said air handler to selectively warm air that passes through said air handler;

in a chill mode, said air handler providing communication between the freezer compartment and said pan, air entering said pan at a temperature less than the first temperature, and in a thaw mode, said heater element configured to heat air within said pan to a temperature greater than the first temperature.

21. A quick chill and thaw system in accordance with claim 20 wherein said air handler is configured for discharging air at a temperature and velocity to maintain a surface temperature of a thawed item in a refrigerated state.

22. A quick chill and thaw system in accordance with claim 21 wherein said surface temperature is about 41° F.

23. A quick chill and thaw system in accordance with claim 21 wherein said air temperature is between about 40° F. to about 50° F.

24. A quick chill and thaw system in accordance with claim 23 wherein said air temperature is about 41° F.

25. A quick chill and thaw system in accordance with claim 20 further comprising a damper element in flow communication with said supply flow path and said return flow path.

26. A quick chill and thaw system in accordance with claim 20 further comprising a recirculation flow path for mixing of air in said air supply flow path with air from said re-circulation path.

27. A quick chill and thaw system in accordance with claim 26 wherein said supply flow path is positioned between said return flow path and said recirculation flow path.

28. A quick chill and thaw system in accordance with claim 20 wherein said heater element is a foil-type heater element.

29. A quick chill and thaw system in accordance with claim 20 further comprising a plenum extension for distributing air within said pan.

30. A quick chill and thaw system for a refrigerator comprising:

a pan;

an air handler adapted for producing convective airflow within said pan; and a rack removably positioned within said pan, said rack comprising a first side configured to support food items to be chilled and an opposing second side configured to support food items to be thawed.

31. A quick chill and thaw system in accordance with claim 30 wherein each of said first side and said second side comprises a plurality of longitudinal members configured to orient food and beverage items in said pan.

32. A quick chill and thaw system in accordance with claim 31 wherein said longitudinal members are straight.

33. A quick chill and thaw system in accordance with claim 31 wherein said longitudinal members are at least partially curved.

34. A quick chill in thaw system in accordance with claim 31 wherein said rack includes first and second ends, said longitudinal members extending non-linearly between said first and second ends.

35. A quick chill and thaw system in accordance with claim 30 further comprising a tray within said pan, said rack removably positioned on said tray.

36. A quick chill and thaw system in accordance with claim 35 wherein said tray is removable from said pan.

37. A quick chill and thaw system in accordance with claim 35 wherein said tray further comprises a handle.

38. A quick chill and thaw system in a refrigerator including a first compartment, said quick chill and thaw system comprising:

a pan; and an air handler comprising an airflow path comprising an air supply path and a return path, and a fan for drawing air through from said airflow path into said pan and from said pan into said airflow path, wherein at least one of said pan and said air handler comprises a light source for illuminating said pan.

39. A quick chill and thaw system in accordance with claim 38 further comprising a recirculation path for mixing air from said pan with air in said air supply flow path.

40. A quick chill and thaw system in accordance with claim 38 wherein said air handler further comprises a heater element for warming air inside said air handler.

41. A quick chill and thaw system in accordance with claim 38 wherein said air handler is adapted for rapid chilling and refrigerated thawing of items placed in said pan.

42. A quick chill and thaw system in accordance with claim 41 wherein said air handler is operable in a chill mode, said air handler moving air at a temperature of about 21° F. in said chill mode.

43. A quick chill and thaw system in accordance with claim 41 wherein said air handler is operable in a thaw mode, said air handler moving air at a temperature and velocity that maintains a surface temperature of a thawed item within acceptable limits.

44. A quick chill and thaw system for a refrigerator including a food storage compartment and a freezer compartment, said quick chill and thaw system comprising:

a pan; and an air handler in flow communication with said pan, said air handler comprising a heater element, in a chill mode, said air handler providing communication between the freezer compartment and said pan and, in a thaw mode, said air handler configured to maintain a substantially constant temperature within said pan.

45. A quick chill and thaw system in accordance with claim 44 wherein said air handler is configured for discharging air at a temperature and velocity to maintain a surface temperature of a thawed item at a thaw temperature.

46. A quick chill and thaw system in accordance with claim 45 wherein said air temperature is about 40° F. to about 50° F.

47. A quick chill and thaw system in accordance within claim 44 wherein said air handler further comprises an air supply flow path and a return flow path.

48. A quick chill and thaw system in accordance with claim 47 further comprising a damper element in flow communication with sad supply flow path and said return flow path.

49. A quick chill and thaw system in accordance with claim 47 further comprising a re-circulation flow path for mixing of air in said air supply flow path with air from said re-circulation path.

50. A quick chill and thaw system for a refrigerator including a fresh food compartment, said quick chill and thaw system comprising:

a pan; and an air handler in flow communication with said pan, said air handler comprising a airflow path comprising a supply path and a return path, and a heater element located in said airflow path, said air handler configured for discharging air at a temperature and velocity to maintain a surface temperature of a thawed item at a thaw temperature.

51. A quick chill and thaw system in accordance with claim 50 wherein said air is about 40° F. to about 50° F.

52. A quick chill and thaw system for a refrigerator including a fresh food compartment, said quick chill and thaw system comprising:

a pan positioned within the fresh food compartment, wherein the fresh food compartment is at a first temperature;

an evaporator in flow communication with said pan;

an air handler defining a passageway providing flow communication between said evaporator and said pan; and a heater element positioned within said passageway.

* * * * *